US011596826B2

(12) United States Patent
Domesick

(10) Patent No.: US 11,596,826 B2
(45) Date of Patent: Mar. 7, 2023

(54) BELT-BASED SYSTEM FOR EXERCISING MUSCLES

(71) Applicant: Michael Harris Domesick, Worcester, MA (US)

(72) Inventor: Michael Harris Domesick, Worcester, MA (US)

( * ) Notice: Subject to any disclaimer, the term of this patent is extended or adjusted under 35 U.S.C. 154(b) by 0 days.

(21) Appl. No.: 15/863,060

(22) Filed: Jan. 5, 2018

(65) Prior Publication Data

US 2018/0126207 A1 May 10, 2018

Related U.S. Application Data

(63) Continuation-in-part of application No. 14/784,834, filed on Oct. 15, 2015, now Pat. No. 9,895,568.

(51) Int. Cl.
*A63B 21/012* (2006.01)
*A63B 21/00* (2006.01)
(Continued)

(52) U.S. Cl.
CPC .... *A63B 21/0125* (2013.01); *A63B 21/00047* (2013.01); *A63B 21/015* (2013.01); *A63B 21/151* (2013.01); *A63B 21/4035* (2015.10); *A63B 21/4037* (2015.10); *A63B 21/4045* (2015.10); *A63B 23/0205* (2013.01); *A63B 23/0211* (2013.01); *A63B 23/0216* (2013.01); *A63B 23/0355* (2013.01); *A63B 23/03541* (2013.01); *A63B 21/005* (2013.01); *A63B 21/008* (2013.01); *A63B 21/00069* (2013.01); *A63B 21/02* (2013.01); *A63B 21/157* (2013.01); *A63B 22/0005* (2015.10);
(Continued)

(58) Field of Classification Search
CPC ..... A63B 21/00047; A63B 21/00069; A63B 21/005; A63B 21/008; A63B 21/0125; A63B 21/015; A63B 21/02; A63B 21/151; A63B 21/157; A63B 21/4035; A63B 21/4037; A63B 21/4045; A63B 22/0005; A63B 22/0023; A63B 22/0285; A63B 22/0292; A63B 2022/0278; A63B 2208/0219; A63B 2208/0295; A63B 2225/093
See application file for complete search history.

(56) References Cited

U.S. PATENT DOCUMENTS 3,659,845 A * 5/1972 Quinton ..... A63B 22/02 482/7
4,151,988 A * 5/1979 Nabinger ..... A63B 22/02 188/72.9
(Continued)

*Primary Examiner* — Megan Anderson

(57) ABSTRACT

Systems and methods are presented for performing exercises to strengthen, e.g., the transversus abdominis and related muscles. The systems and methods may involve one or more independent belts, allowing a full range of continuous motion. The systems and methods may further use a resistance-control mechanism that allows a user to adjust the force required to move the one or more belts, thereby controlling the rate of motion in the forward and/or backward directions. The systems and methods may further use a unidirectional resistance mechanism that allows the user to increase the resistance of the one or more belts in one direction, while allowing the one or more belts to move freely in the other direction.

15 Claims, 41 Drawing Sheets

(51) Int. Cl.

| | |
|---|---|
| ***A63B 23/02*** | (2006.01) |
| ***A63B 22/02*** | (2006.01) |
| ***A63B 23/12*** | (2006.01) |
| ***A63B 21/02*** | (2006.01) |
| ***A63B 21/015*** | (2006.01) |
| ***A63B 23/035*** | (2006.01) |
| *A63B 21/005* | (2006.01) |
| *A63B 21/008* | (2006.01) |
| *A63B 22/00* | (2006.01) |

(52) U.S. Cl.

CPC ..... *A63B 22/0023* (2013.01); *A63B 22/0285* (2013.01); *A63B 22/0292* (2015.10); *A63B 23/1236* (2013.01); *A63B 2022/0278* (2013.01); *A63B 2208/0219* (2013.01); *A63B 2208/0295* (2013.01); *A63B 2225/093* (2013.01)

(56) References Cited

U.S. PATENT DOCUMENTS 5,860,512 A * 1/1999 Gianvito ..... B65G 15/02 198/831
5,951,441 A * 9/1999 Dalebout ..... A63B 22/02 198/844.2
6,042,514 A * 3/2000 Abelbeck ..... A63B 22/02 198/439
7,549,938 B2 * 6/2009 Leighton ..... A63B 22/02 474/268
7,553,260 B2 * 6/2009 Piaget ..... A63B 22/0056 482/51
7,909,719 B2 * 3/2011 Leighton ..... B65G 15/34 474/264
8,096,925 B2 * 1/2012 Radding ..... A63B 22/02 264/41
8,608,624 B2 * 12/2013 Shabodyash ..... A61H 11/00 482/51
8,986,176 B2 * 3/2015 Arst ..... A63B 21/015 482/119
9,012,341 B2 * 4/2015 Rohr ..... A63B 22/02 442/221
9,352,188 B2 * 5/2016 Astilean ..... A63B 22/02
9,433,819 B1 * 9/2016 Carducci ..... A63B 22/0285
10,478,666 B2 * 11/2019 Yoo ..... A63B 22/0285
2013/0281241 A1 * 10/2013 Watterson ..... A63B 22/0285 474/268
2016/0144224 A1 * 5/2016 Dalebout ..... A63B 22/02 482/54
2017/0312567 A1 * 11/2017 Chang ..... A63B 21/15

* cited by examiner

401

402

Prior Art

Prior Art

Figure 29.1
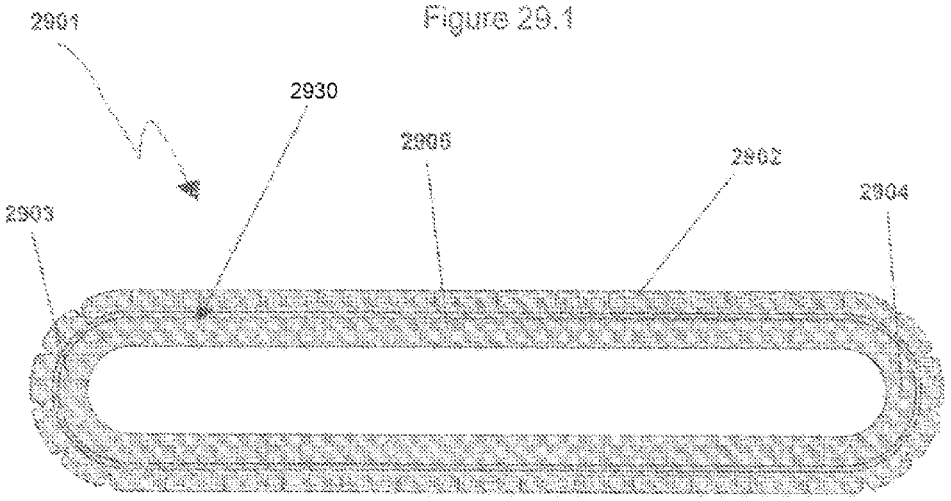

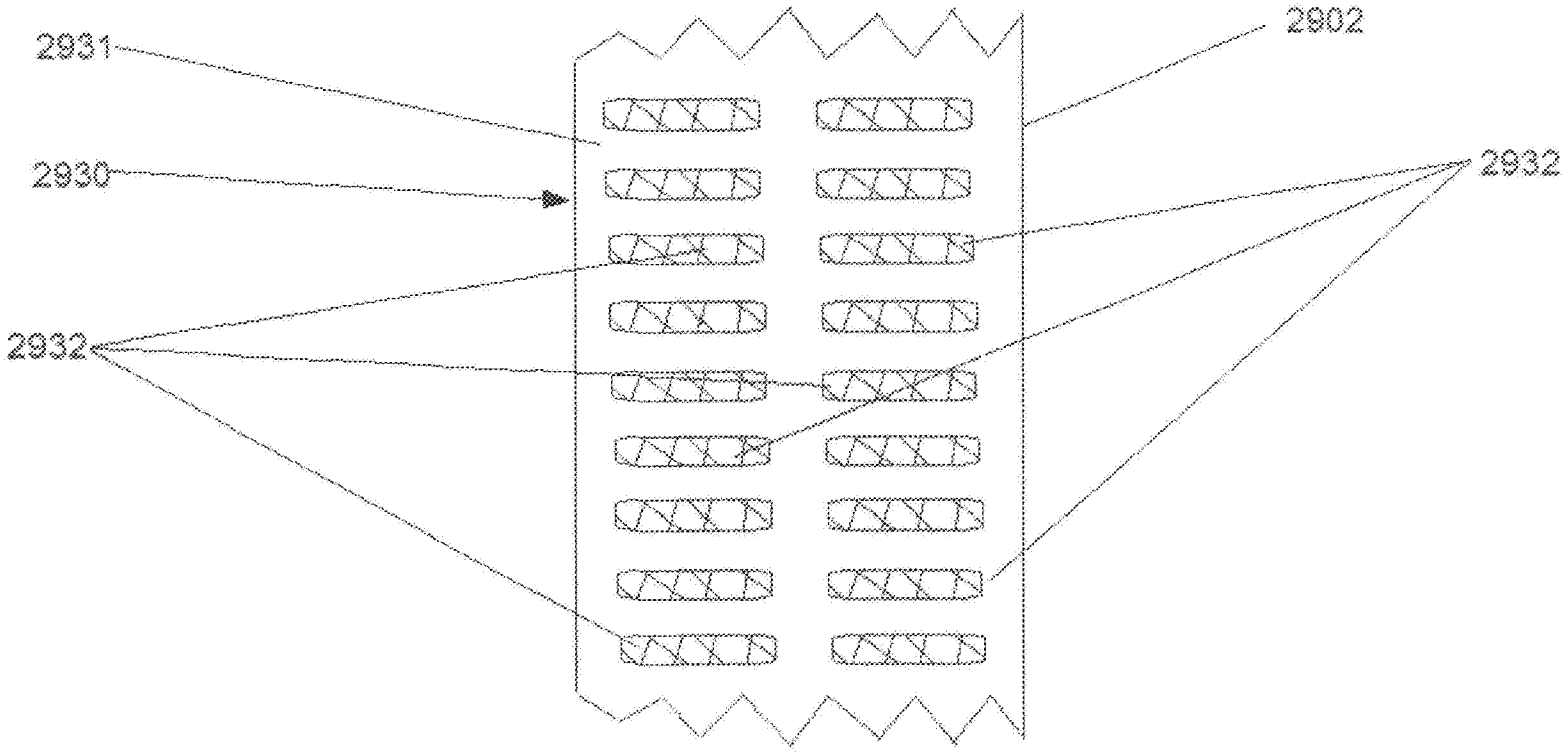
Figure 29.2

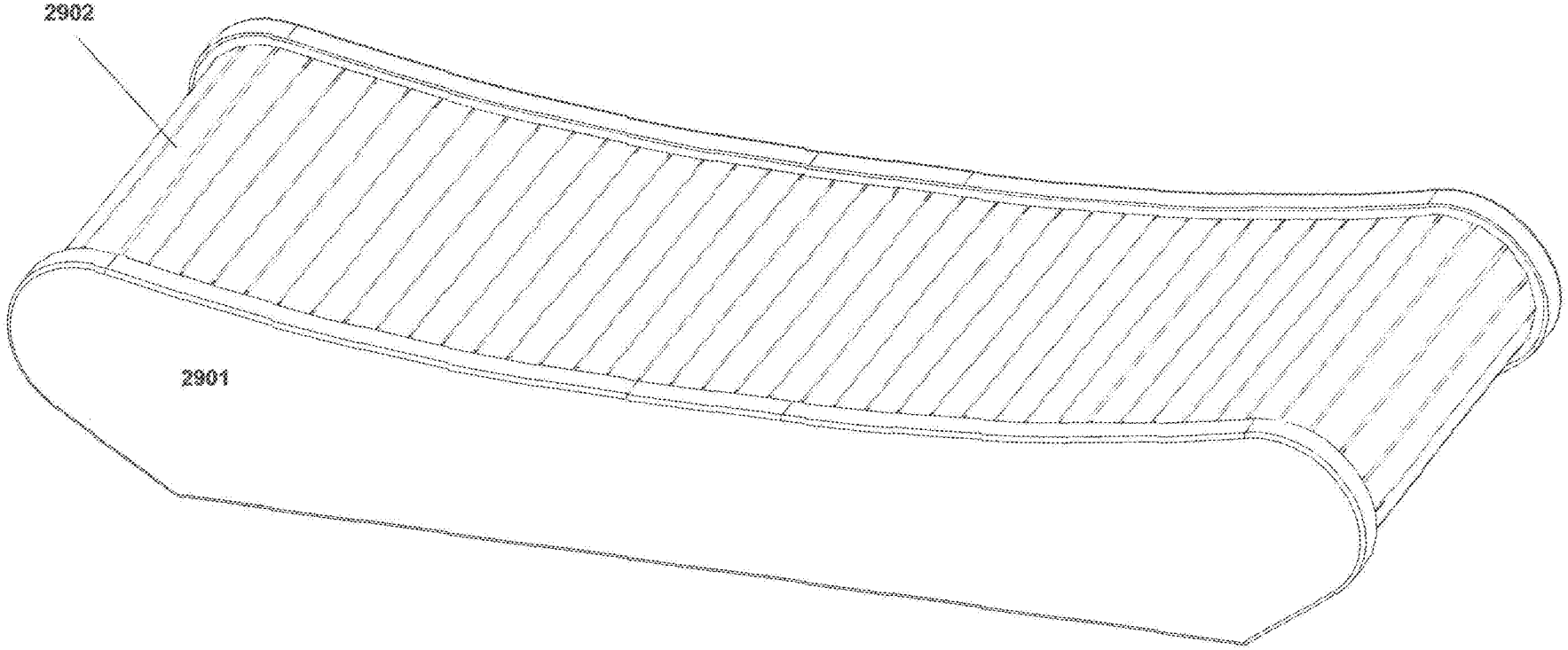
Figure 29.3

Figure 29.4
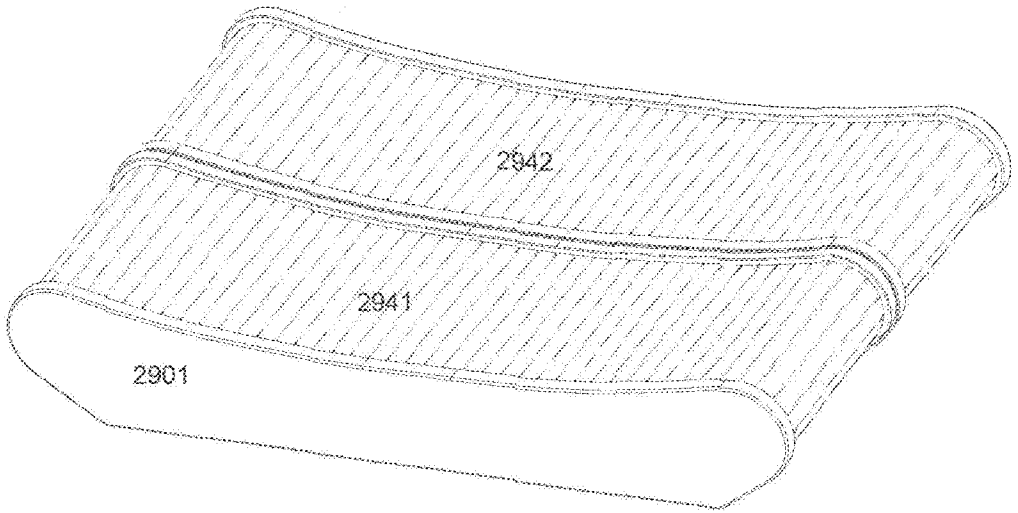

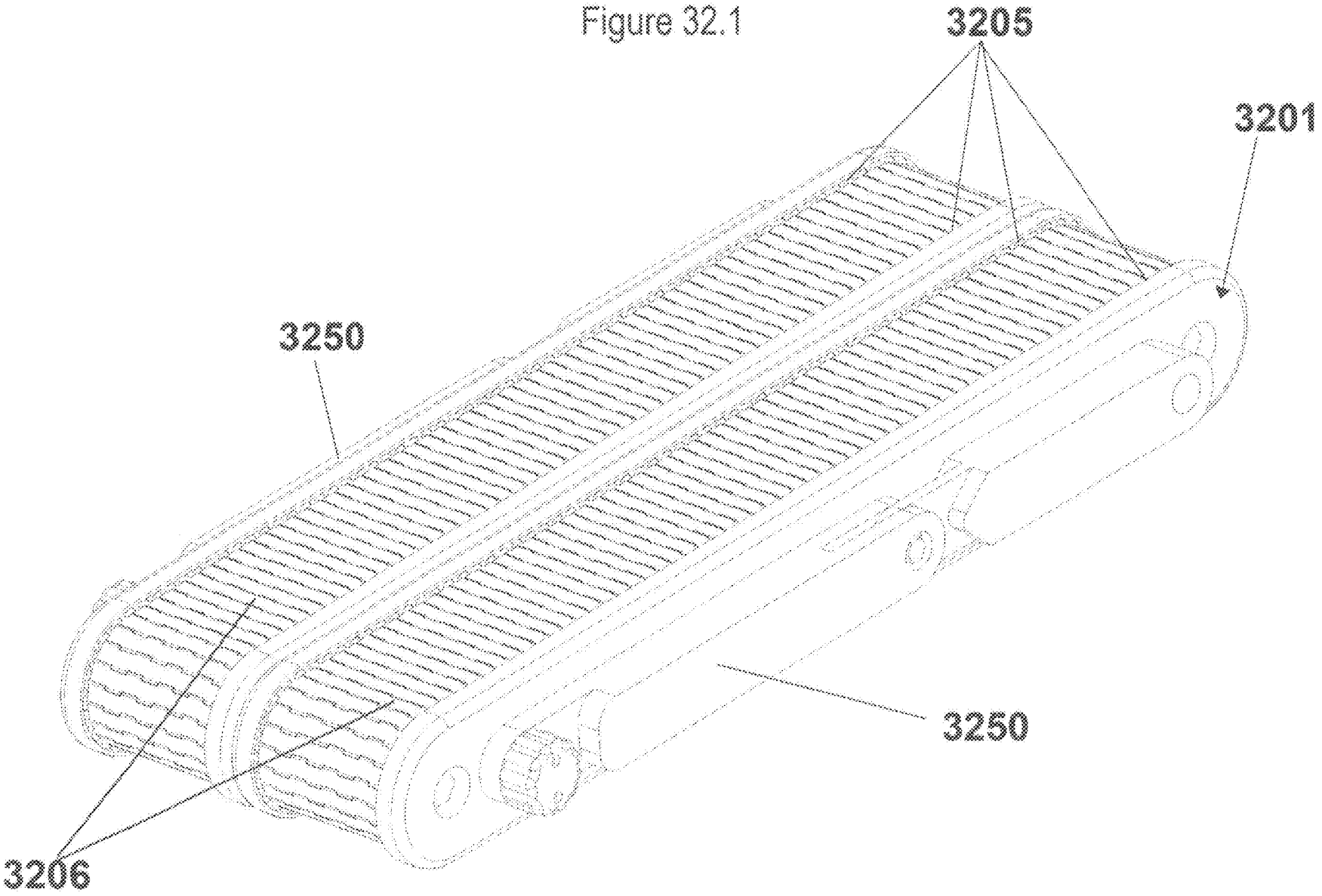
Figure 32.1

BELT-BASED SYSTEM FOR EXERCISING MUSCLES

This application is being filed as a continuation-in-part of U.S. patent application Ser. No. 14/784,834 entitled, "Belt-Based System for Strengthening Muscles," and claims benefit thereof.

BACKGROUND

Field of the Invention

The present invention relates generally to exercise systems and, more specifically, to systems for strengthening, e.g., the abdominal muscles and related muscle groups.

Discussion of Related Art

Exercises designed to strengthen muscles such as the transversus abdominis muscle and related muscle groups have long played an important role in workout routines intended to improve fitness and health. The abdominal muscles come into play in almost every functional movement that involves the body's "core" components. Also, exercising these muscles can flatten the stomach and minimize the paunchy appearance of abdominal muscular sag or fat deposits, even in otherwise slender, fit individuals.

According to some researchers and fitness experts, three of the best exercises for engaging, e.g., the transversus abdominis and toning the core include: ab rollouts (illustrated in FIGS. 4A and 4B and described below), reverse ab rollouts (illustrated in FIGS. 5A and 5B and described below), and ab planks (illustrated in FIG. 19 and described below). The first of these exercises, the "ab rollout", has been the basis of several fitness products in the past: the "Ab Wheel," the "Ab Slide," and the "Torso Track."

The "Ab Wheel," shown in FIG. 16, consists of a wheel with two side handles. To use an Ab Wheel, one assumes a kneeling or standing position, grasps the handles, and rolls forward across the floor, then back. The basic principle is this: because gravity tends quickly to propel us forward, one is forced to engage one's transversus abdominis to slow the forward rate of motion and maintain balance. However, using an Ab Wheel properly requires a relatively high degree of initial abdominal conditioning. Without the proper experience and conditioning, exercising with the Ab Wheel can cause hyperextension.

The Ab Slide (shown in FIG. 17) and the Torso Track (shown in FIG. 18) were designed to slow the rate of forward motion, thereby making the exercise easier and less dangerous to perform. However, neither of these products is fully adjustable, allowing the user to freely vary the level of forward resistance. The Ab Slide, implemented using a torsion spring, was designed with a one-size fits all approach and is not at all adjustable. The Torso Track, implemented using rubber bands, had only two or three difficulty settings, and switching among them required the user to manually adjust rubber bands.

In addition, both the Ab Slide and the Torso Track allowed only a limited range of motion, and could be used to perform a limited number of exercises. The Ab Slide could only slide a short distance before the torsion spring wound up completely, preventing further movement. The Torso Track could only move as far as its rubber bands could stretch. Also, both the Ab Slide and the Torso Track were designed primarily for an ab rollout-type motion, ignoring reverse ab rollouts and planks, two of the three most important abdominal exercises referred to above.

SUMMARY OF THE INVENTION

Herein are described systems for performing a variety of abdominal exercises, the systems including a rigid framework, a first belt configured to roll relative to the framework in both clockwise and counter-clockwise directions, a second belt configured to roll relative to the framework in both clockwise and counter-clockwise directions, and a resistance control mechanism for controlling the amount of force required to roll the first and second belts in one or more of the clockwise and counter-clockwise directions.

Herein are further described systems including a rigid framework, a single belt configured to roll relative to the framework in both clockwise and counter-clockwise directions, and a resistance-control mechanism for controlling the amount of force required to roll the belt in one or more of the clockwise and counter-clockwise directions.

Embodiments of the present invention may employ one-way resistance-control mechanisms that control the resistance in only the clockwise or the counter-clockwise direction, but not both. Embodiments of the present invention may include belts that run along substantially parallel paths. Embodiments may include detachable or integrated risers that are used to create an incline. Embodiments may include belts that are constructed of modular segments linked by hinged interconnects, or a one-piece fixed-length belt which approximates the look and feel of a modular belt.

Embodiments of the present invention may employ one or more rigid or semi-rigid belts that include bottom-facing rollers or sprockets designed to reduce friction. Embodiments of the present invention may employ a framework that includes upward-facing rollers or sprockets designed to reduce friction. Embodiments of the present invention may include belts that rest on glide-strips constructed using a low-friction material such as, e.g., polyethylene.

BRIEF DESCRIPTION OF THE DRAWINGS

For a more complete understanding of various embodiments of the present invention, reference is now made to the following descriptions taken in connection with the accompanying drawings in which:

FIG. 29.1 shows a horizontal cross-section of a system with a unitary plastic belt, according to some embodiments.

FIG. 29.2 shows a slide-inducing matrix, according to some embodiments.

FIG. 29.3 shows a system with a concave slider deck, according to some embodiments.

FIG. 29.4 shows a system with a concave slider deck and dual belts, according to some embodiments.

FIG. 32.1 shows a dual belt system, according to some embodiments.

DETAILED DESCRIPTION

Figure 1:
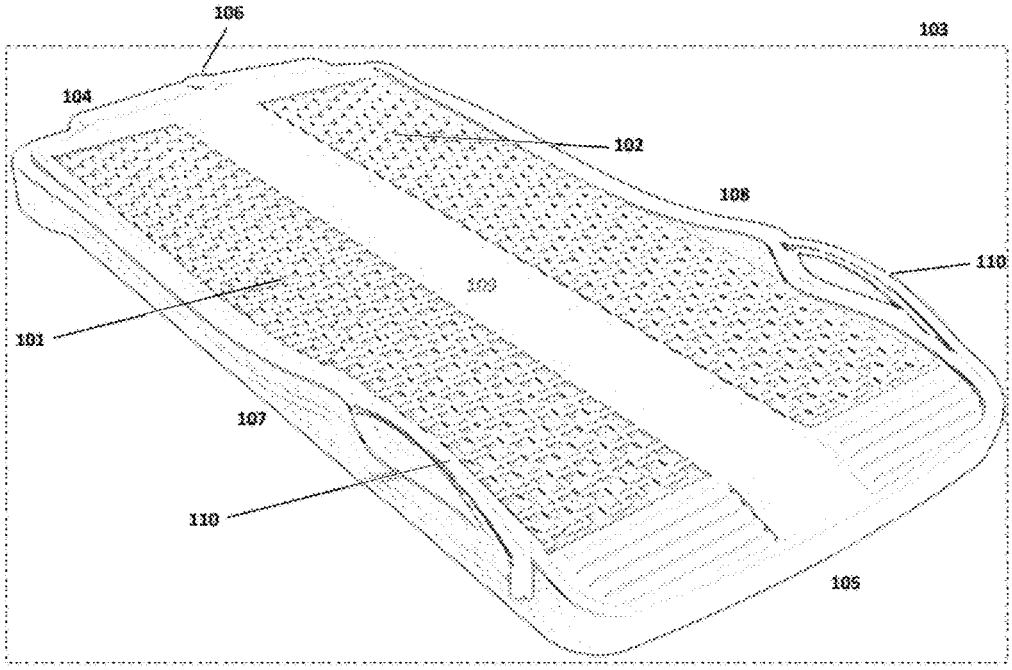
FIG. 1 shows a system with two continuous belts, left and right handles, resistance control knob, and side/center trim, according to some embodiments.

FIG. 1 illustrates one embodiment of the present invention. Continuous belts 101, 102 are looped around axles that allow them to roll in a direction parallel to the long axis of framework 103. In some embodiments, belts 101, 102 may roll bi-directionally, in both "forward" and "backward" directions, depending on the direction of the force that is applied to the top surface of the belt. Applying a force pointing toward front end 104 causes a belt to roll in the "forward" direction, such that points on the top surface of the belt move toward the front end 104 of the framework; applying a force pointing toward back end 105 causes the belt to roll in the "backward" direction, such that points on the top surface of the belt move toward the back end 105 of the framework.

Figure 2:
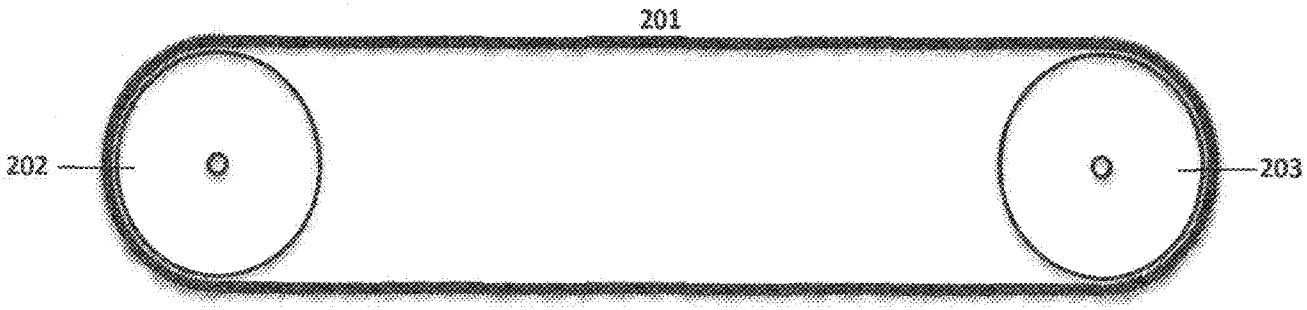
FIG. 2 is a schematic showing a cross-section of a belt looped around front and back axles, forming a continuous loop, according to some embodiments.

In some embodiments, each belt forms a continuous loop around front and back axles, located respectively at the front 104 and back 105 ends of framework 103. FIG. 2 shows a horizontal cross section of this loop for a single belt. Belt 201 is looped around front axle 202 and back axle 203, so it may roll continuously in both the forward (clockwise) and backward (counterclockwise) directions. Sprockets (not shown) may be placed around the axles to prevent the belt from slipping relative to the front and back axles. Further, referring again to FIG. 1, the axles around which belt 101 is looped may be decoupled from the axles around which belt 102 is looped. Thus, in some embodiments, the two belts may roll independently of each other; at any particular time, the two belts may be rolling at different rates, or in different directions.

In some embodiments, the force required to roll belts 101, 102 relative to framework 103 may be controlled by resistance control knob 106. For example, turning resistance control knob 106 in a clockwise direction may increase the force required to roll the belts, while turning the knob in a counterclockwise direction may decrease the force required to roll the belts. In some embodiments, resistance control knob 106 controls the force required to roll the belts in the forward direction only, while the belts may be rolled in the backward direction by applying a minimal amount of force. This may be accomplished using mechanisms such as one-way bearings, as described in more detail below.

In the embodiment shown in FIG. 1, the majority of belts 101, 102 are hidden from view at any given time, only the top surfaces of the belts are visible. At both the front 104 and back 105 ends, framework 103 includes "trim" that conceals the axles around which the belts are looped, so the visible portions of the belts form substantially planar surfaces. Trim is also included on the left 107 and right 108 sides of the framework, concealing the outer rims of bolts 101, 102, and along a strip 109 in the middle of the framework, concealing the inner rims of the belts. The trim on the four sides and along the center of the framework prevents damage to the machine and minimizes the risk of injury to the user by shielding and protecting the axles, the resistance control mechanism, and other moving parts. Handles 110 are fixed to the left 107 and right 108 sides of the framework.

Embodiments like the system pictured in FIG. 1 may be designed to allow multiple such systems to be stacked vertically for storage. In such embodiments, each machine in a stack may interlock with the machines immediately above and beneath it, preventing it from moving horizontally relative to its neighbors. Embodiments may be designed to allow vertical stacks in which every machine in the stack has the same orientation (i.e., every machine in the stack is face-up, with the front and back ends pointing in the same direction), or stacks in which adjacent machines are oriented differently (e.g., stacks in which every other machine is rotated 180° around a vertical axis so the bottom surface of the front end of one machine is stacked atop the top surface of the back end of another; stacks in which every other machine is flipped upside-down so the top surface faces downward and touches the top surface of the machine immediately beneath it, and the bottom surface faces upward and touches the bottom surface of the machine immediately above it). To allow for the most efficient use of space, stackable embodiments may be designed to minimize the vertical distance between adjacent machines in a stack, thereby minimizing the height of the stack as a whole.

Figure 3:
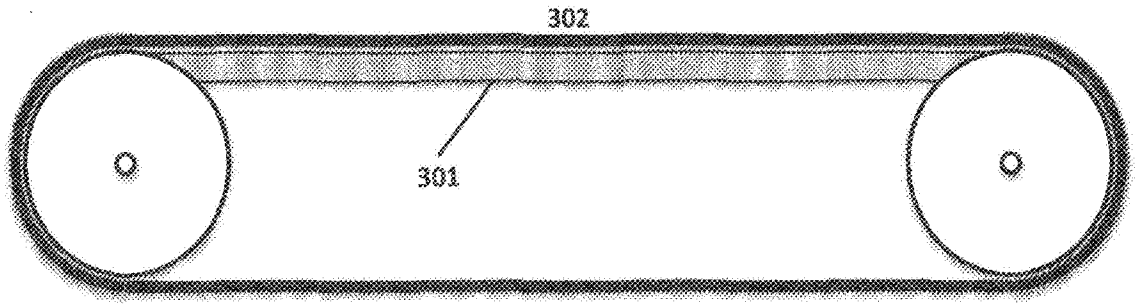
FIG. 3 is a schematic showing a cross-section of a belt looped around front and back axles supported by a slider deck, according to some embodiments.

Framework 103 may be constructed from a variety of materials, including wood, plastic, rubber, and metal (or some combination of the four). As shown in FIG. 3, in some embodiments, a "slider deck" 301 may be located immediately beneath the top portion of a belt 302. The slider deck prevents a belt from buckling or deforming when downward pressure 303 is applied to the top surface of the belt. When a belt is rolled forward or backward, it slides along the slider deck. Friction between the moving belt and the slider deck may be minimized by applying a lubricant (e.g., silicon or generic Teflon) to the top surface of the slider deck and/or to the inner surface of the belt. In addition, the inner surface of the belt and/or the upper surface of the slider deck may be constructed using materials designed to minimize friction (e.g., plastic, silicon, or generic Teflon slider strips).

Figure 4A:
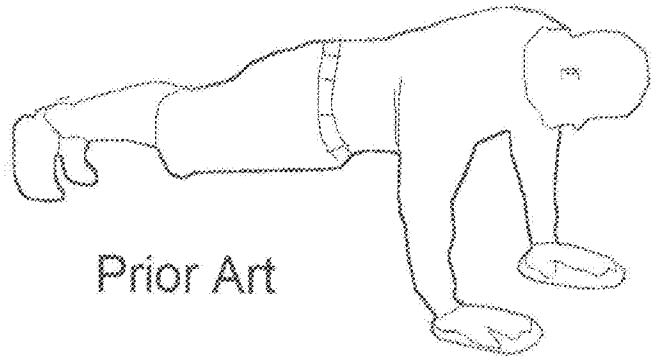
FIGS. 4A and 4B show the movements involved in an "ab rollout" exercise, according to some embodiments.
Figure 4B:
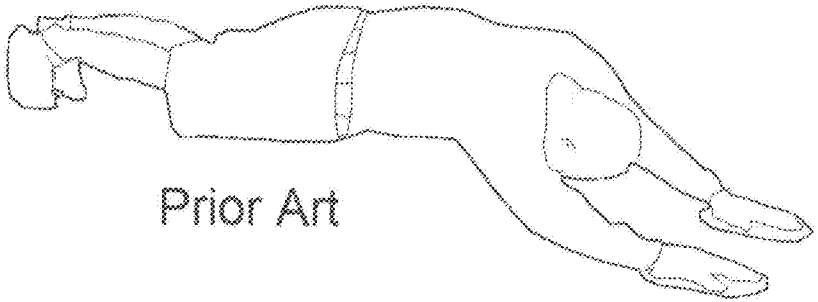
Prior Art Figure 4B
Figure 5A:
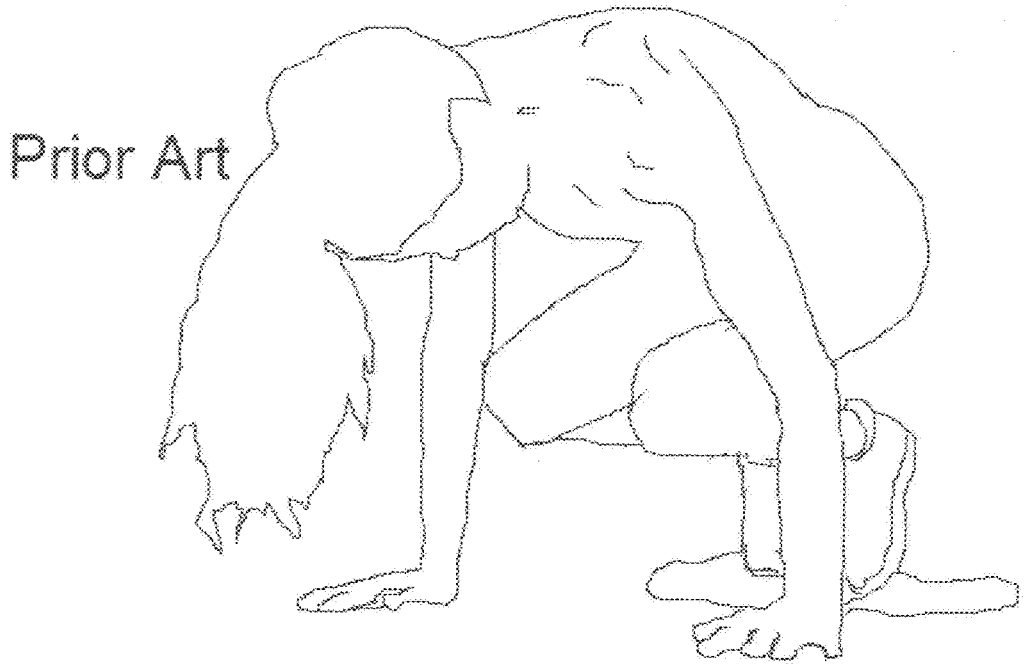
FIGS. 5A and 5B show the movements involved in a "reverse ab rollout" exercise, according to some embodiments.
Figure 5B:
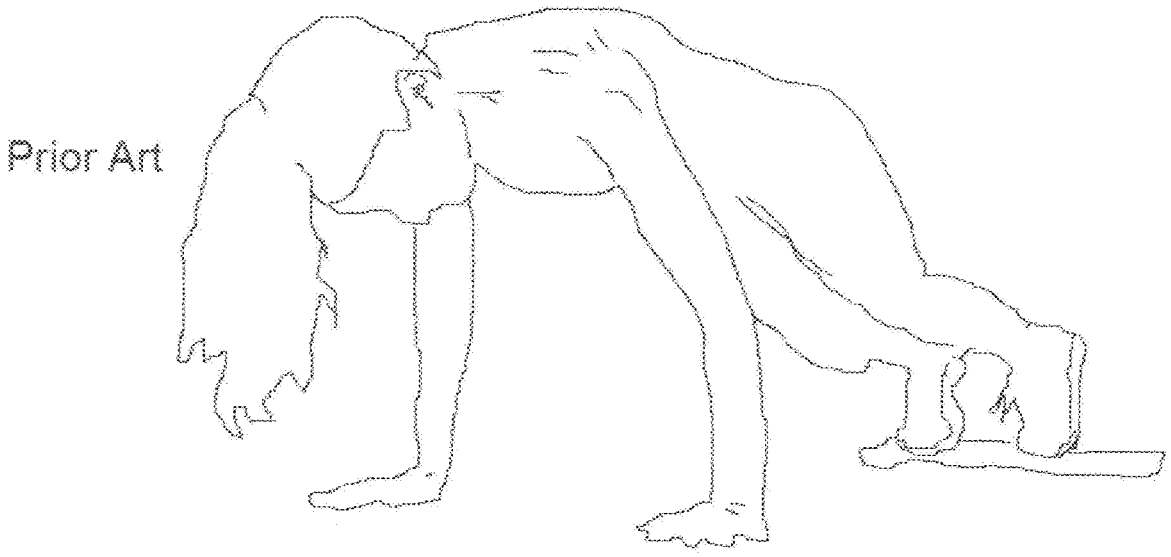

The embodiment shown in FIG. 1 may be used to perform a variety of exercises, such as the "ab rollout" illustrated in FIGS. 4A and 4B, and the "reverse ab rollout" illustrated in FIGS. 5A and 5B. An "ab rollout" is a three-step exercise: (1) a user begins in position 401 (FIG. 4A); (2) the user moves his/her hands forward to reach position 402 (FIG. 4B); and (3) the user moves his/her hands backward, returning to position 401. The forward/backward movement of the hands may be facilitated by belts 101, 102 (shown in FIG. 1): first, in the starting position 401, the user's left hand is placed atop left belt 101, and the user's right hand is placed atop right belt 102; then, the user's hands apply a forward force (toward front end 104), causing the belts to roll forward, until position 402 is reached; finally, the user's hands/torso apply a backward force (toward back end 105), causing the belts to roll backward, returning to position 401. The embodiment of FIG. 1 may also be used to perform a "single-hand ab rollout," which is similar to an "ab rollout," except that the user is supported by only one hand throughout the exercise.

The embodiment shown in FIG. 1 may also be used to perform a "reverse ab rollout," illustrated in FIGS. 5A and 5B. Like the "ab rollout," the "reverse ab rollout" is a three-step exercise: (1) a user begins in position 501 (FIG. 5A); (2) the user moves his/her feet backward to reach position 502 (FIG. 5B); and (3) the user moves his/her feet forward, returning to position 501. The forward/backward movement of the user's feet may be facilitated by belts 101, 102 (shown in FIG. 1): first, in the starting position 501, the user's left foot is placed atop left belt 101, and the user's right foot is placed atop right belt 102; then, the user's feet apply a backward force (toward back end 105), causing the belts to roll backward, until position 502 is reached; finally, the user's feet apply a forward force (toward front end 1 04), causing the belts to roll forward, returning to position 501 (alternatively, reverse ab rollouts may be performed facing in the other direction, in which moving the feet backward causes the belts to roll forward, and vice versa). The embodiment of FIG. 1 may also be used to perform a "single-foot reverse ab rollout," which is similar to a "reverse ab rollout," except that the user is supported by only one foot throughout the exercise.

Additional exercises may be performed with the embodiment shown in FIG. 1, including, but not limited to, push-ups, lunges, planks, and manual treadmilling. Push-ups are facilitated by handles 110, which may be used as push-up handles. Lunges are performed by (1) starting in a push-up position, with head pointing toward front end 104 and feet on belts 101, 102; and (2) sliding the feet forward, bringing the knees toward the chest, for as long as possible. Planks are performed by (1) kneeling on belts 101, 102 and grasping handles 110; and (2) lifting the knees off the belts, such that the user's weight is supported entirely by the hands and toes, while keeping the hips in-line with the body. Manual treadmilling is performed by (1) placing the hands on belts 101, 102 in a push-up position; and (2) "walking" either forward or backward, using the left and right hands alternately to roll the left and right belts (manual treadmilling may be performed with the user's head facing front end 104, or back end 105). The descriptions above do not constitute an exhaustive list of the exercises that may be performed with embodiments of the present invention, but serve as illustrative examples only.

Figure 6:
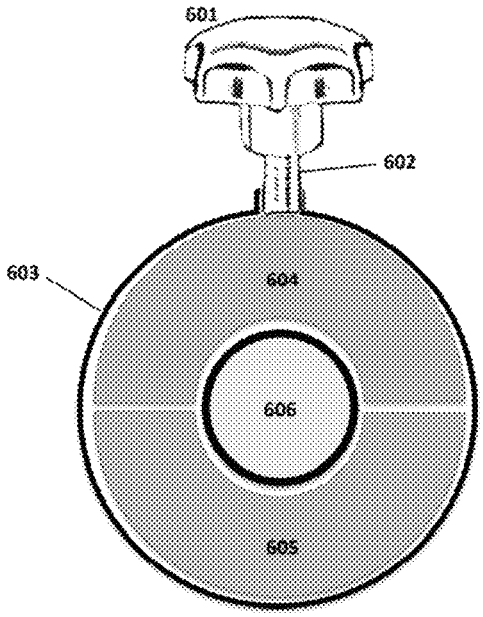
FIG. 6 is a schematic showing a cross-section of the resistance-adjustment mechanism, according to some embodiments.

As described above, resistance control knob 106 may be used to control the amount of force required to roll belts 101, 102. In some embodiments, this is accomplished using a mechanism like the one illustrated in FIG. 6, which is a schematic diagram showing a horizontal cross-section of the resistance-control mechanism. Resistance control knob 601 is connected to screw 602, which passes through axle housing 603, and presses against the top half of annular friction element 604. Annular friction element (including top half 604 and bottom half 605) is constructed using an elastic material with a high kinetic friction coefficient, such as rubber; thus, when screw 602 is moved downward, resistance axle 606 is compressed between the upper 604 and lower 605 halves of the annular friction element, increasing the inward normal force on the outer surface of resistance axle 606, which increases the amount of torque that is required to rotate resistance axle 606. In some embodiments, resistance axle 606 runs parallel to the front axle of a belt, and is connected to the front axle (e.g., front axle 202 of belt 201, as shown in FIG. 2), so the force required to move the belt in the forward and/or backward direction is proportional to the torque required to rotate resistance axle 606. Thus, turning resistance control knob 601 clockwise increases the belt's resistance, and turning resistance control knob 601 counter-clockwise decreases the belt's resistance.

Two independent belts may be adjusted using the same friction tensioner: for example, the front axle of one belt may be connected to a resistance axle that is inserted into one end of annular friction element 604, 605, and the front axle of the other belt may be connected to a resistance axle that is inserted into the other end of annular friction element 604, 605. In this case, both resistance axles may rotate independently, but a single resistance control knob 601 may be used to adjust the torque required to turn both resistance axles. Alternatively, other embodiments may employ separate resistance-control mechanisms for each belt.

Various alternative techniques may be used to adjust the force required to roll a belt in one or both directions (e.g., torsion springs, magnetic or hydraulic tensioners, rubber bands, etc.). The resistance-control mechanism described above with reference to FIG. 6 is provided as an illustrative example only.

In some embodiments, the user may adjust the force required to move the belt in the forward direction without changing the force required to move the belt in the backward direction. As explained above, resistance in the forward direction is desirable for "ab rollouts" and similar exercises to counterbalance the tendency of gravity to push the body forward, but movement in the backward direction goes against the force of gravity, so additional resistance is unnecessary. Such embodiments may use a variety of mechanisms to accomplish this unidirectional resistance-control, such as the one-way bearing mechanisms described below.

Figure 7:
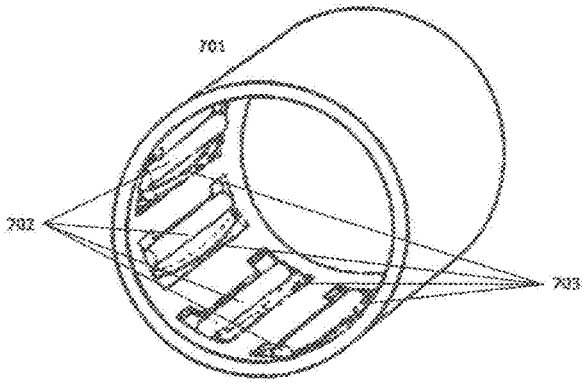
FIG. 7 shows a one-way bearing enclosure with cavities that house rollers and springs, according to some embodiments.

One-way bearings are used in a variety of mechanical devices in order to allow an object to be rotated in one direction, but not the other. As shown in FIG. 7, bearing enclosure 701 is lined with grooved cavities, each of which contains a roller 702 and a spring 703. An inner axle (not shown in FIG. 7) runs through the middle of bearing enclosure 701. As explained below, the configuration of rollers and springs allows the inner axle to rotate independently of the bearing enclosure 701 only in the counter-clockwise direction. For the inner axle to rotate in the forward (i.e., clockwise) direction, it must rotate the bearing enclosure 701 along with itself. Therefore, resistance applied to the bearing enclosure 701 when a belt is rolling in the forward direction will slow down the movement of the belt in the forward direction, but not affect or provide resistance to the belt while the belt moves in the backward direction (i.e., toward the user).

Figure 8A:
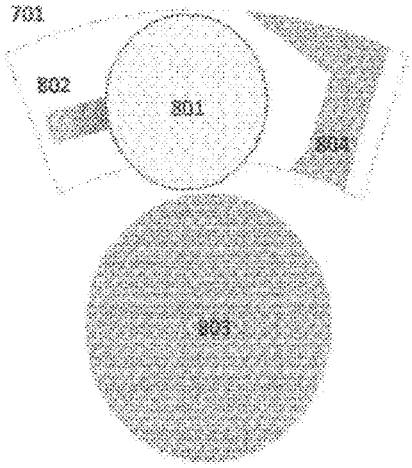
FIG. 8A shows a one-way bearing mechanism in a "free" position, in which the bearing enclosure may rotate independently of the inner axle, according to some embodiments.
Figure 8B:
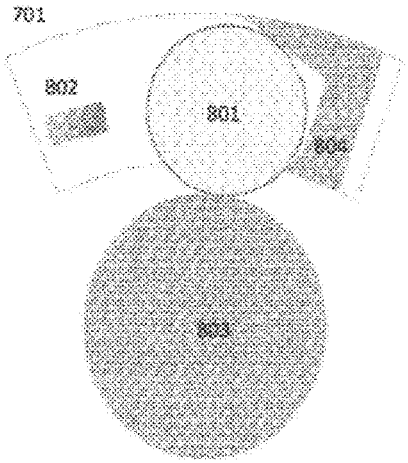
FIG. 8B shows a one-way bearing mechanism in a "locked" position, in which the bearing enclosure may not rotate independently of the inner axle, according to some embodiments.

FIGS. 8A and 8B show a portion of the one-way bearing mechanism in greater detail. These figures show a cross-section of a single grooved cavity in bearing enclosure 701. Roller 801 occupies the right side of the cavity, and spring 802 occupies the left side. In FIG. 8A, the mechanism is in the "free" position: because the roller 801 is not tangent to the right side of the cavity and not impeding the rotation of inner axle 803. As a result, the inner axle 803 is free to rotate independently of the bearing enclosure. As long as the roller 801 is in the "free" position (as it is when the inner axle 803 is rotating counterclockwise), the inner axle 803 will rotate independently of the bearing enclosure 701.

However, if inner axle 803 rotates in the clockwise direction, it will move the roller 801 to a position where it is trapped against the bearing cage 804, as shown in FIG. 8B (in which the mechanism is in the "locked" position). In this "locked" position, the inner axle 803 is not free to rotate independently of bearing enclosure 701; rotating the inner axle 803 further in the forward (i.e., clockwise) direction is only possible if bearing enclosure 701 rotates with it.

In one embodiment of the present disclosure, the bearing enclosure 701, shown in FIGS. 7, 8A, and 8B, may be coupled to a friction element (e.g., annular friction element 604, 605, shown in FIG. 6) that is configured to apply variable resistance to an outer surface of the bearing enclosure 701. In addition, in this configuration, the inner axle 803, shown in FIGS. 8A and 8B, may serve as an axle conveying a belt (e.g. front axle 202 of belt 201, shown in FIG. 2). As a result, in this configuration, the belt will roll freely in the one direction (i.e., the backward direction) because the inner axle 803 is not subject to the resistance provided by the friction element (e.g. the annular friction element 604, 605 shown in FIG. 6) when the inner axle 803 is rotating in the counter-clockwise direction independently of the bearing enclosure 701. However, the belt will encounter resistance when rolling in the forward direction, because rotating the inner axle 803 in the clockwise direction requires rotating the bearing enclosure 701 as well. Therefore, with the belt moving in the forward direction, resistance applied to the bearing enclosure 701 will also affect the forward motion of the belt and, therefore, slow it down in that direction. Accordingly, embodiments of the present invention may use this mechanism to increase the force required to roll a belt in one direction (e.g., forward, away from the user, or clockwise), while allowing it to roll freely or without added resistance from a friction element or friction brake in the other (e.g., backwards, toward the user, or counter-clockwise). This result may also be achieved with a variety of alternative techniques (e.g., ratchet-based assemblies, etc.); the one-way bearing mechanism described above with reference to FIGS. 7, 8A, and 8B is provided as an illustrative example only.

Figure 9:
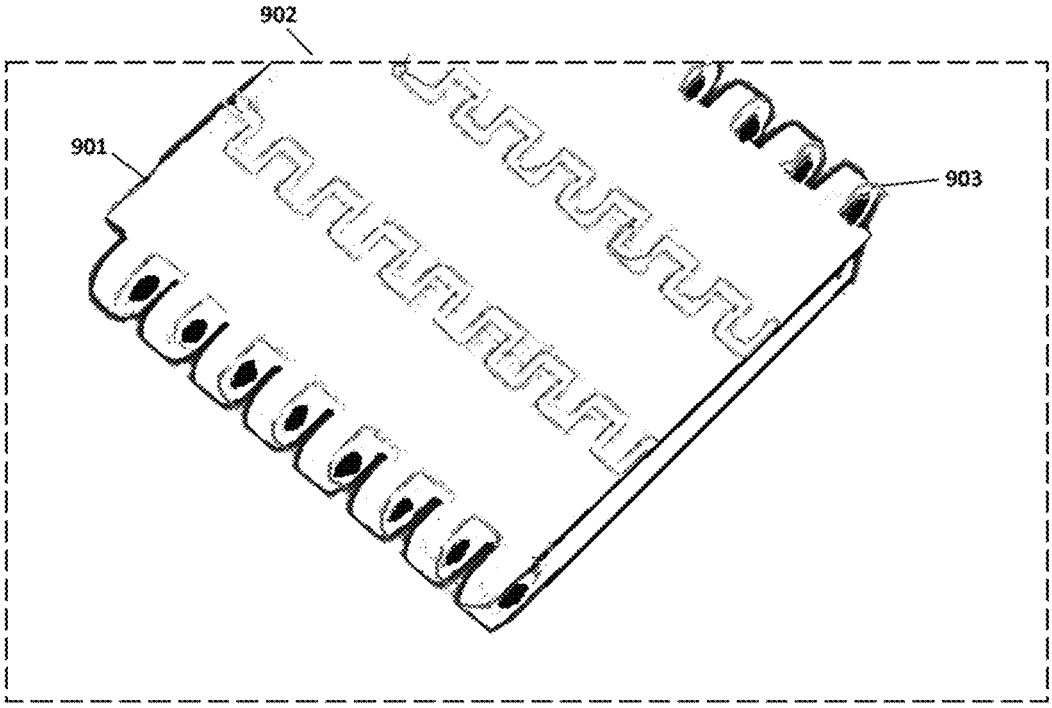
FIG. 9 shows a belt segment constructed using multiple modular belt elements, according to some embodiments.

Embodiments of the present invention may include one or more belts constructed using a variety of techniques and materials. In some embodiments, belts may be constructed using modular belt elements as illustrated in FIG. 9. Modular belt elements 901, 902, 903 interlock to form belt segments of arbitrary length. These belt segments may be formed into a continuous belt (like, e.g., belt 201 shown in FIG. 2) by attaching the modular belt element at one end of the belt segment to the modular belt element at the other end of the belt segment. Such belts are durable, relatively easy to repair, and modifiable. Repairing belts constructed using modular elements is easy and relatively inexpensive; when such a belt is damaged, it can often be fixed by replacing only the damaged belting elements, and rarely requires replacing the entire belt. Modular belts can also be lengthened or shortened as desired by adding or removing modular belt elements.

Figure 10:
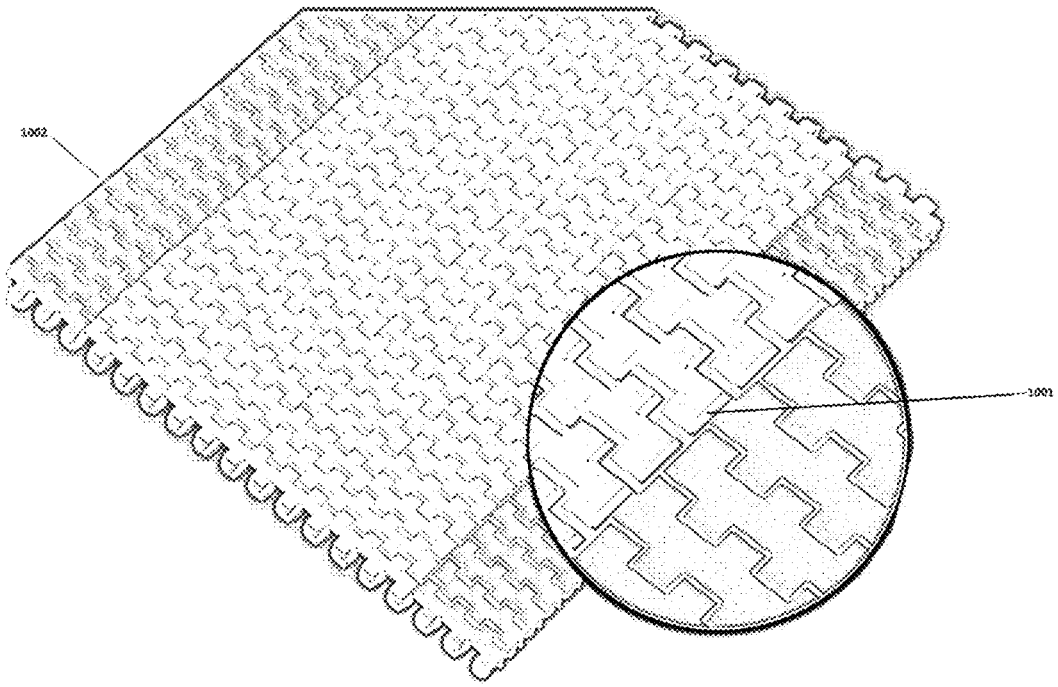
FIG. 10 shows a belt segment with an easy-to-grip strip running down its length, according to some embodiments.
Figure 11:
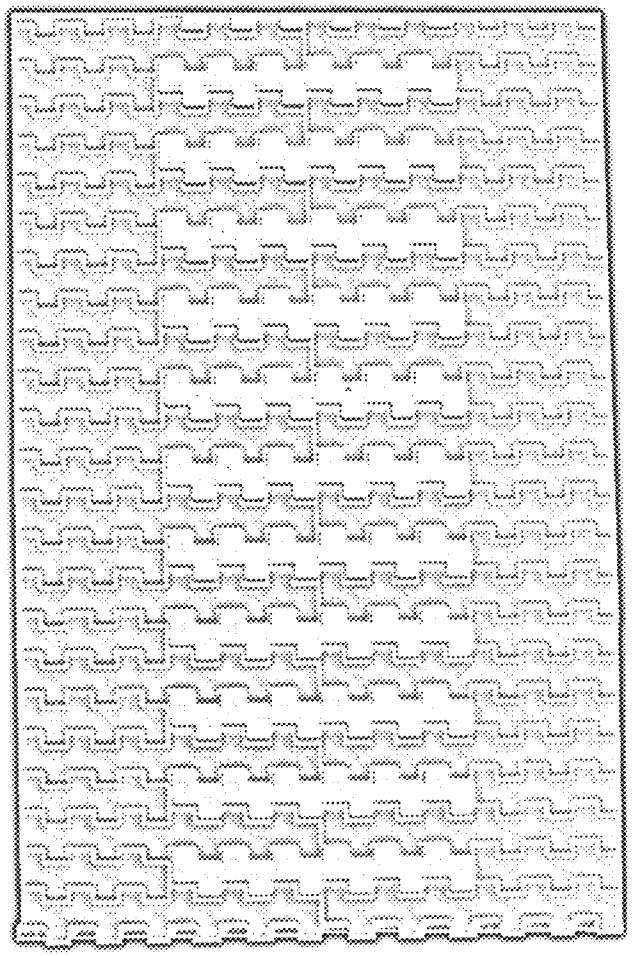
FIG. 11 shows a belt segment in which alternate belting elements are partially coated with an easy-to-grip surface, according to some embodiments.

In some embodiments, each modular belt element is totally or partially coated in a surface designed to prevent a user's hands and feet from slipping, and to provide a satisfying tactile experience. FIG. 10, shows a belt segment in which the middle upper portion of each modular belt element is coated with a rubberized, easy-to-grip surface 1001. These belting elements are assembled to form a belt with a strip of rubberized material 1002 running down its center. Other embodiments may include belts in which every other belting element is partially coated with a rubberized surface, as shown in FIG. 11. Embodiments of the present invention may use a variety of belt materials and configurations (e.g., belts made of rubber, plastic, fabric, some combination of these materials, etc.). Also, embodiments may include a one-piece fixed-length belt which approximates the look and feel of a modular belt. The descriptions of modular belts above, with reference to FIGS. 9-11, are provided as illustrative examples only.

Figure 12:
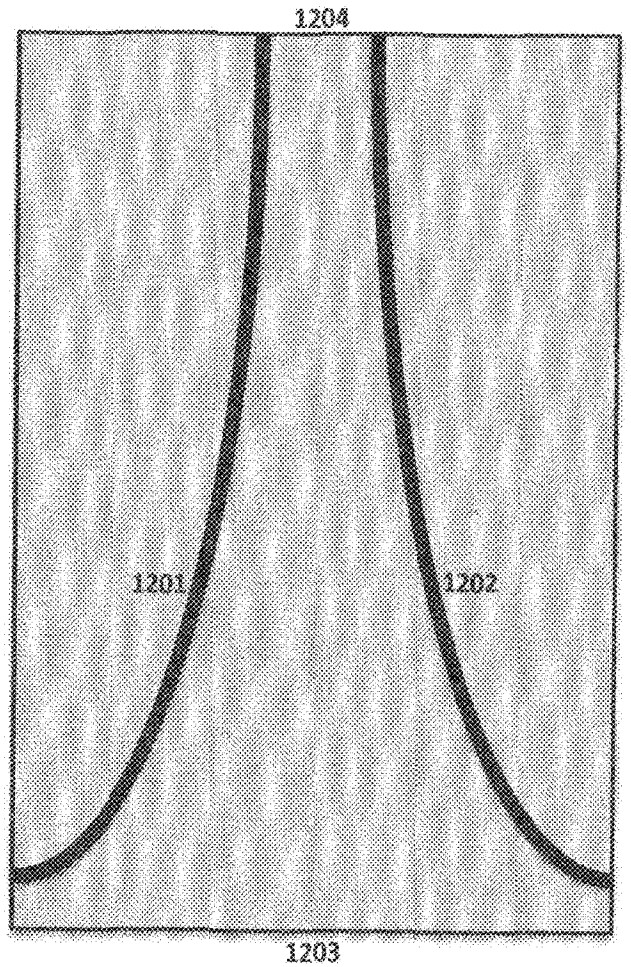
FIG. 12 shows the trajectories of two curved belts, according to some embodiments.

The embodiment illustrated in FIG. 1 has two parallel belts, but in other embodiments, one or more belts may be partially curved. For example, as illustrated in FIG. 12, a system may include two belts 1201 and 1202 that follow curved trajectories. At the back end 1203 of the device, the two belts are not parallel to each other. As the belts run along the device, they curve symmetrically away from each other, so that when they reach the front end 1204, they are parallel to each other. While the back axles of these two belts are not collinear, the front axles are, and may be adjusted using a single resistance-control mechanism as described above with reference to FIG. 6.

Figure 13:
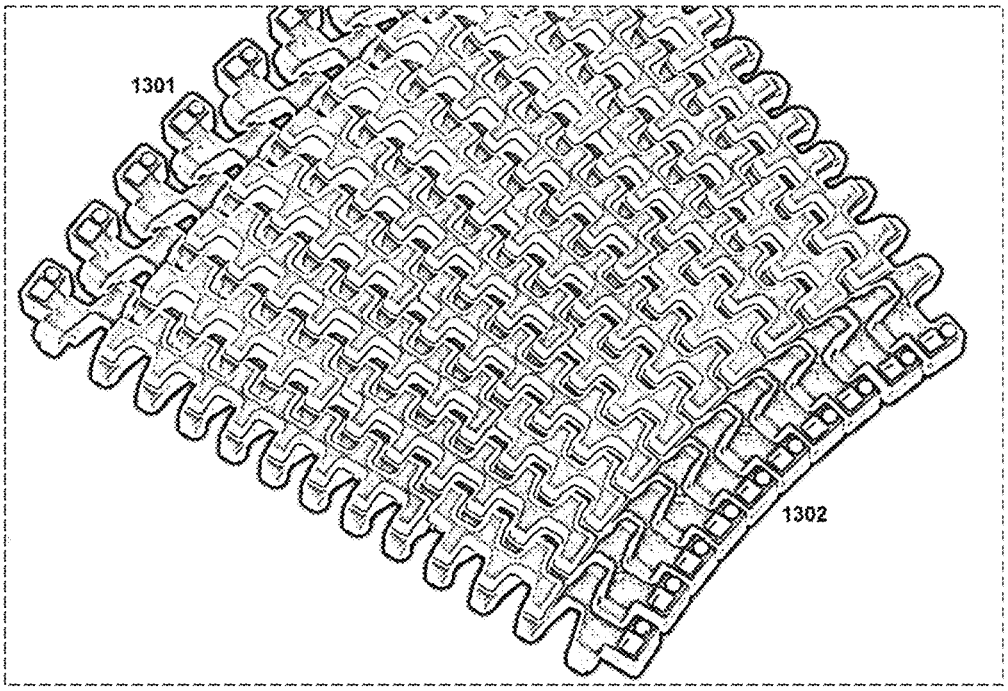
FIG. 13 shows a curved belt segment constructed from modular belt elements that are joined elastically, according to some embodiments.

To allow a belt to follow a curved trajectory, modular belt elements may be attached to each other elastically. In a curved belt segment, the outside of the curve is longer than the inside of the curve. As illustrated in FIG. 13, elastic connections allow increased separation between belting elements near the outside of the curve 1301, while maintaining close spacing between the belting elements near the inside of the curve 1302.

Some embodiments may include belts that allow users to attach hand-grips or other attachable modules to the surface of the belt. For example, a user may attach hand-grips to belts 101, 102. In such embodiments, exercises that involve placing hands on one or both belts may instead be performed by gripping one or both of the attached hand-grips. Analogous foot-grip modules may be attached to belts 101, 102 for performing exercises that involve placing feet on one or both belts. Some embodiments include belts that are designed to roll continuously even when one or more attachment modules are present; in such embodiments, the attachment module rolls with the belt along the underside of the machine until it is once again on the top surface of the belt.

In other embodiments, when an attachment module reaches the front or back end of the machine, it prevents the belt from rolling forward or backward, respectively. Such modules can be used to prevent injury, e.g., overextending the arms when performing an "ab rollout." Before beginning the ab rollout, the user positions the attachment module far enough from the front end of the machine to allow a suitable range of forward motion, but close enough to stop the forward motion of the belt before the user extends their arms too far. Such modules can also be used to limit the belt's range of backward motion. Similarly, two attachment modules may be attached to the belt—one near the front end of the machine, the other near the back end—to limit the belt's movement in both the forward and the backward directions.

Figure 14:
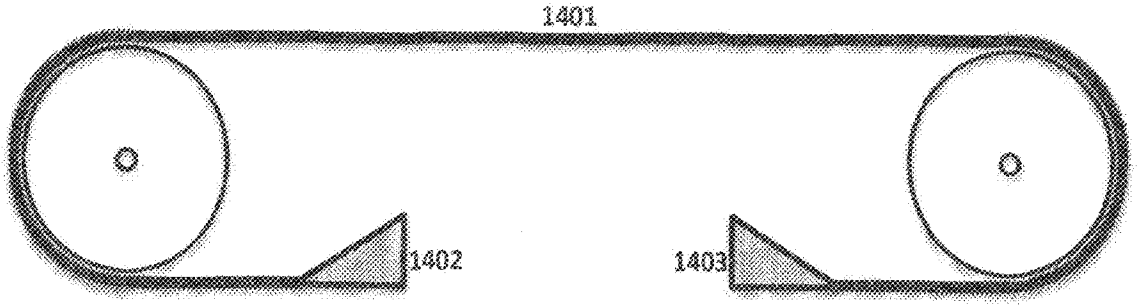
FIG. 14 shows a non-continuous belt segment with stopping elements, according to some embodiments.

In some embodiments, a belt's movement may also be limited by using a linear belt segment as illustrated in FIG. 14, instead of a belt that forms a continuous loop. In these embodiments, the belt is not designed to roll continuously in the forward or backward directions; instead, it has a finite range of motion. In some embodiments, a belt segment 1401 is terminated by stopping elements 1402 and 1403 that prevent further motion when they reach the front or back ends of the machine, respectively.

As described above, some embodiments of the present invention include two independent belts, which may follow a curved or a parallel trajectory, or a combination of the two. However, other embodiments may include only one belt. Because they include only one belt instead of two, single-belt embodiments are faster and less expensive to manufacture than dual-belt embodiments. While single-belt machines do not allow the flexibility and range of motion possible with dual-belt machines, they may still be used for a wide variety of exercises.

In some embodiments, a riser may be placed beneath one end of the machine to create an inclined plane, which may be desired to adjust the difficulty of an exercise. If a riser is placed under the front end of the machine, the belts will slope upward as they roll in the forward direction. If a riser is placed under the back end of the machine, the belts slope downward as they roll forward. In some embodiments, the underside of the machine is designed to accommodate a riser under either the front end or the back end.

Figure 30:
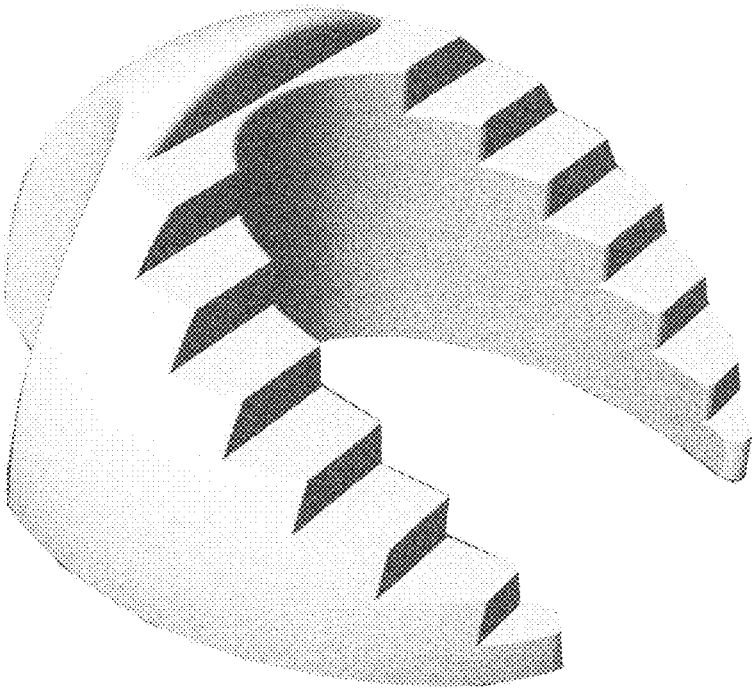
FIG. 30 shows a standalone, gradated riser, according to some embodiments.
Figure 31:
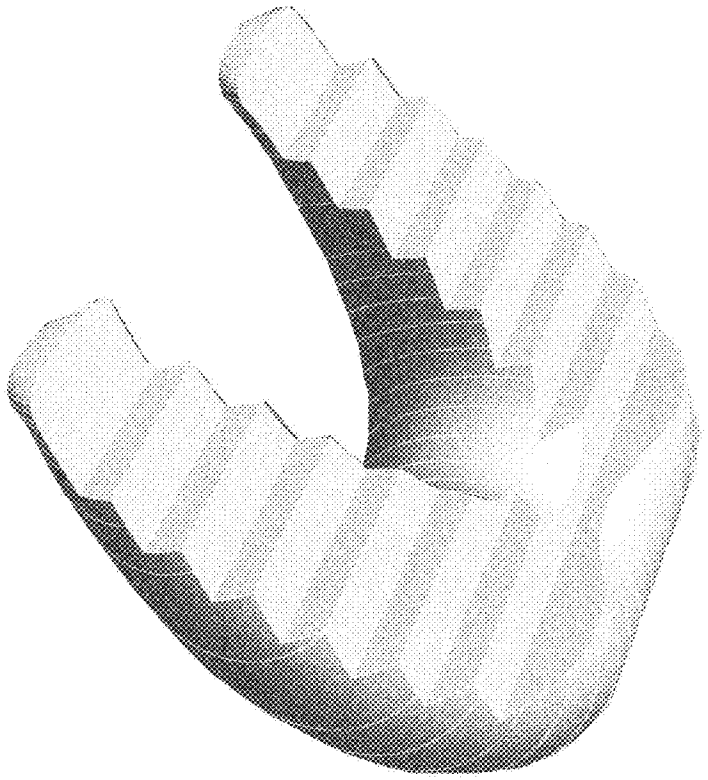
FIG. 31 shows a standalone, gradated riser, according to some embodiments.

In some embodiments, risers may be gradated, as shown in FIGS. 30 and 31, providing multiple, adjustable incline options. This allows users to control the force with which gravity pulls them forward when performing exercises. Placing a riser under the front of the system creates an "uphill" slope that makes ab-rollouts and other exercises less strenuous, while placing a riser under the back of the system creates a "downhill" slope that increases the difficulty of various exercises.

Figure 15A:
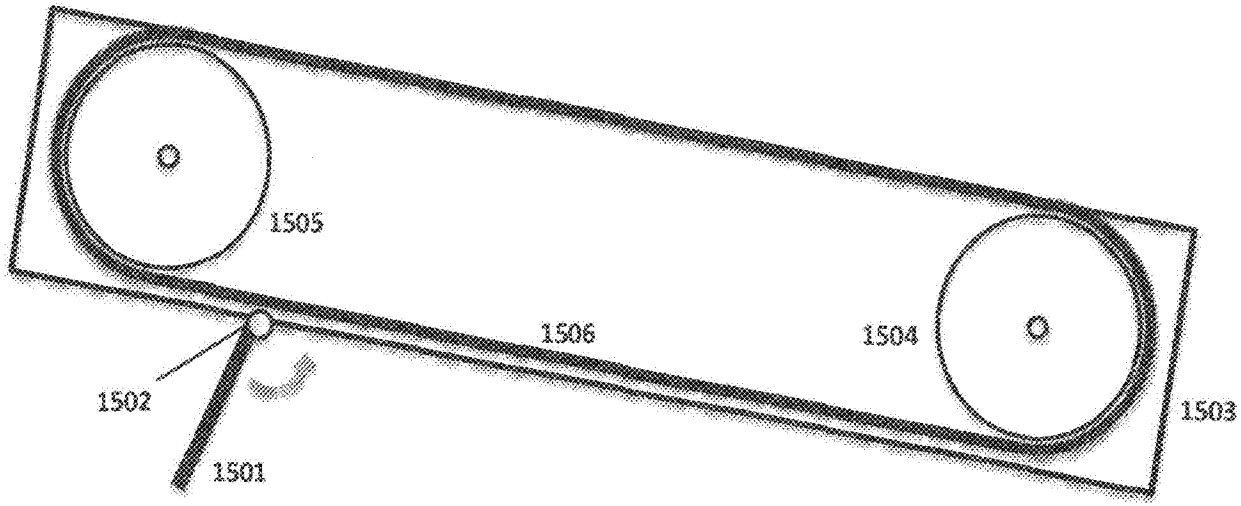
FIG. 15A shows a machine with an integrated, deployable riser under the front end of the machine, according to some embodiments.
Figure 15B:
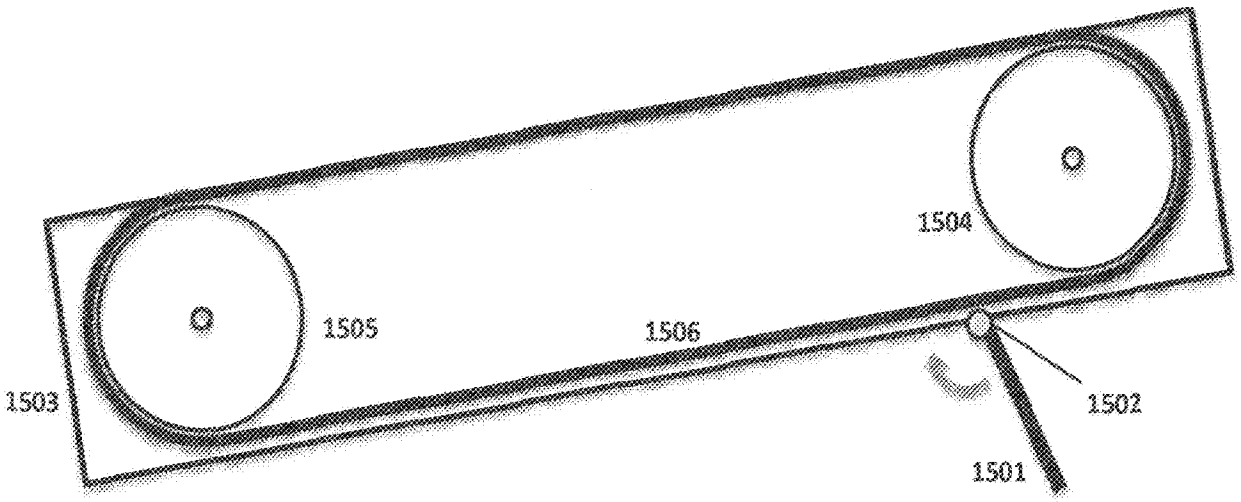
FIG. 15B shows a machine with an integrated, deployable riser under the back end of the machine, according to some embodiments.
Figure 16:
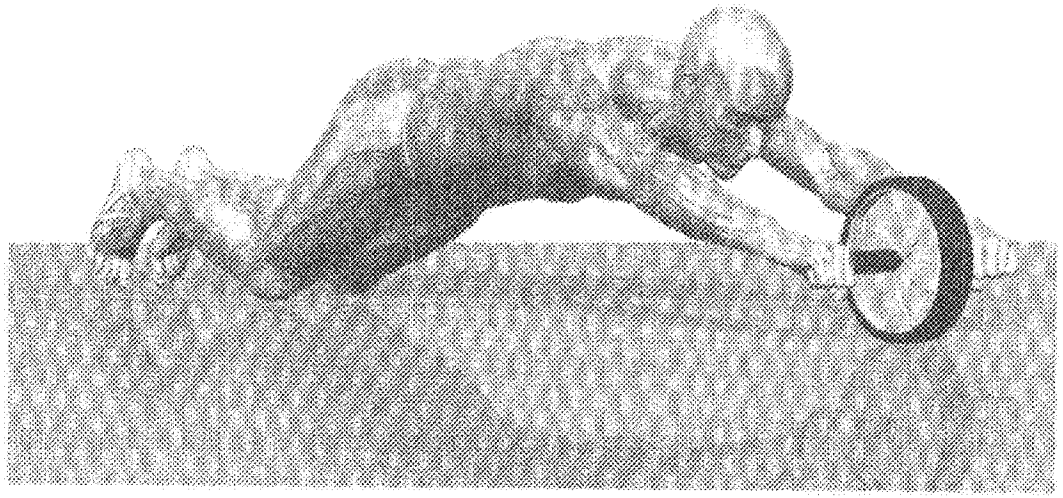
Figure 16 Prior Art
FIG. 16 shows the Ab Wheel, an existing abdominal exercise device.
Figure 17:
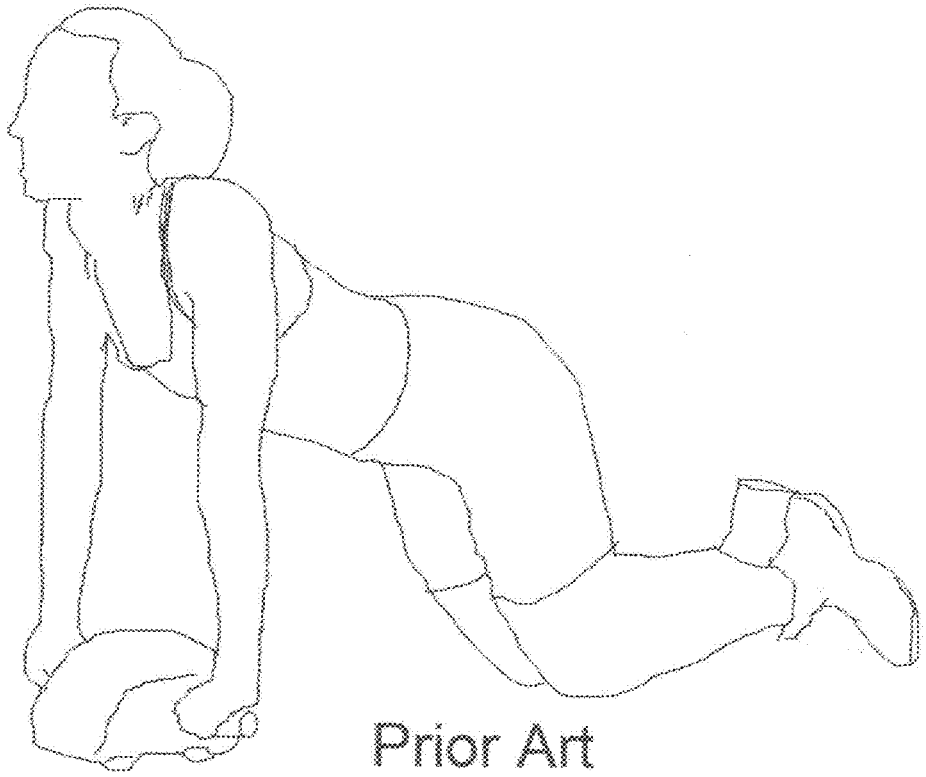
FIG. 17 shows the Ab Slide, an existing abdominal exercise device.
Figure 18:
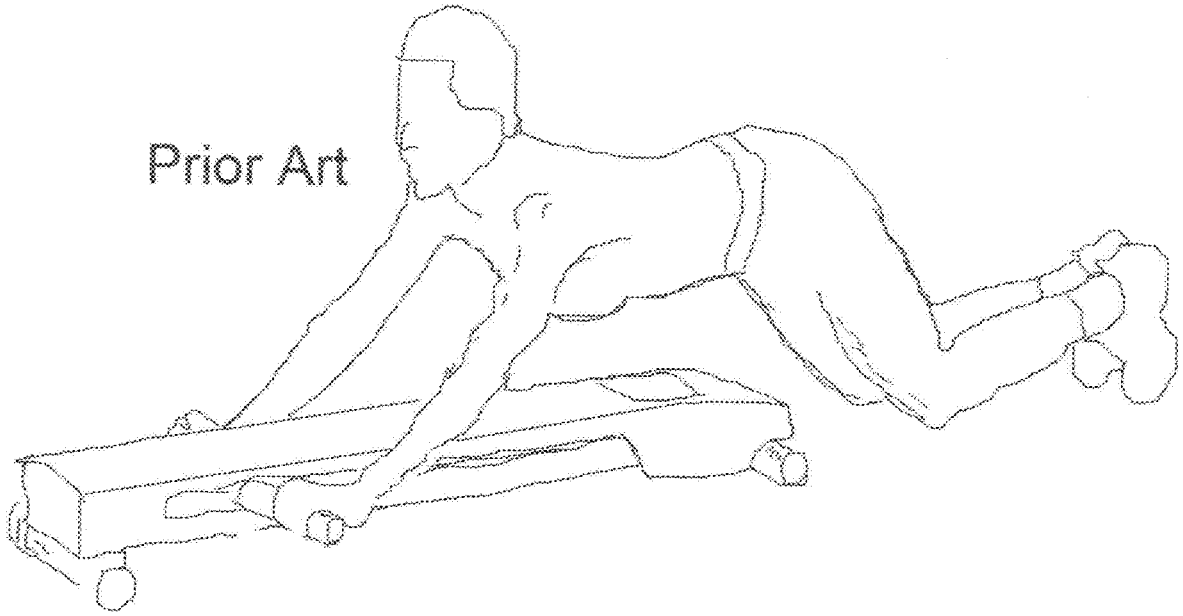
FIG. 18 shows the Torso Track, an existing abdominal exercise device.
Figure 19:
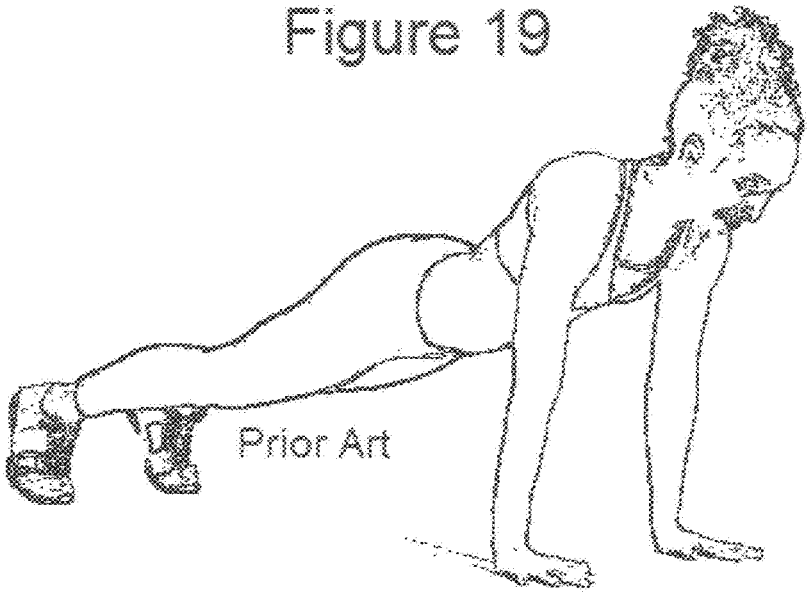
FIG. 19 shows an "ab plank" exercise, according to some embodiments.

Risers may be separate, attachable modules, or may be integrated into the machine itself and deployable as desired. For example, an integrated riser may be implemented as a fold-out panel that is attached to the underside of the machine using a hinge, as illustrated in FIG. 15A. When deployed, the riser 1501 swings out on hinge 1502 and locks into position, protruding from the underside of the machine, and causing framework 1503, supporting belt 1506 looped around front axle 1505 and back axle 1504, to become inclined. When not deployed, the riser 1501 is flush with the underside of the machine. Embodiments may include two integrated risers, one at the front end of the machine and the other at the back, allowing the user to create an upward or a downward incline. Similarly, an integrated riser may be deployed under the back end of the machine, creating a downward incline, as shown in FIG. 15B.

Risers may also be adjustable, providing steeper or shallower inclines as desired. For example, fold-out riser 1501 may be deployed at various angles, each associated with a locking mechanism allowing the riser to be fixed in place at a particular angle. Alternatively, some embodiments may be provided with multiple riser attachments, each one providing an incline of a different slope.

Some embodiments may use a grooved runner system that works without axles or sprockets. In such embodiments, the side edges of full-length belts or hand- or foot-sized "treadpads" consisting of left and right belt segments would be inserted into two parallel grooves running in either an oval-shaped path (e.g., the path of the belt in FIG. 2) in the case of full-length belts, or in a planar path representing the top running along the top surface of the machine, in the case of treadpads. These belts or treadpads could then be moved in both the forward and the backward direction along the grooves, which in some embodiments could be lined with rollers to facilitate movement of the belts or treadpads. The foregoing embodiments may include a resistance-control mechanism for controlling the force needed to move the belts or treadpads forward or backward. For example, they may employ a friction-based control mechanism similar to the one described above with reference to FIG. 6.

Figure 20:
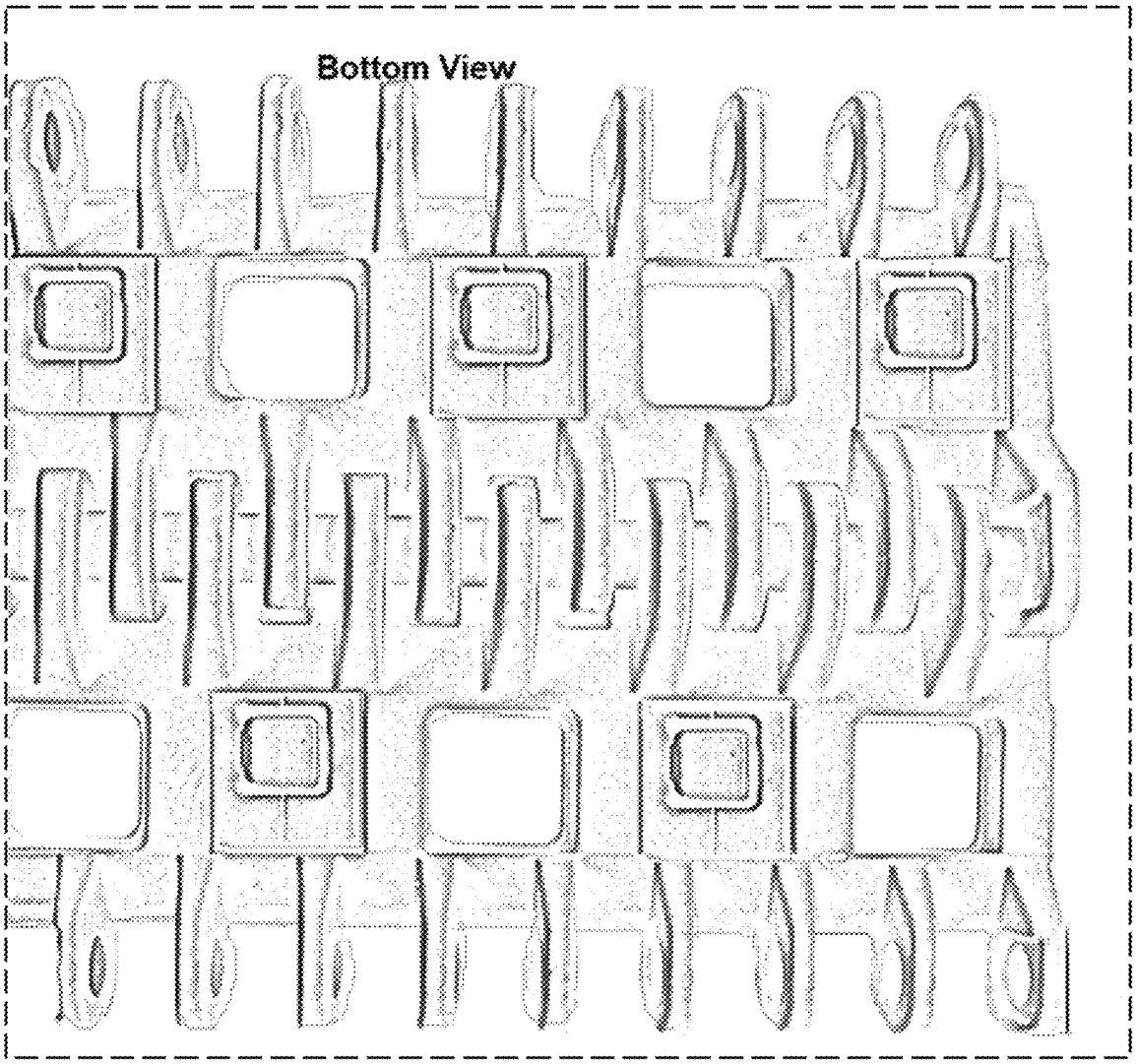
FIG. 20 shows a belt that includes rollers, according to some embodiments.

Some embodiments may include one or more rigid or semi-rigid plastic or rubber belts that include downward-facing rollers that allow the belt to roll over the surface of the slider deck, reducing the friction between the belt and the slider deck. This allows the belt to roll more smoothly in both the forward and backward directions, and further reduces wear. A view of the underside of a belt that includes rollers is shown in FIG. 20. The upper side of a belt as shown in FIG. 20 may feature a flat or flat/contoured surface suitable for hand- or foot-placement.

Figure 21:
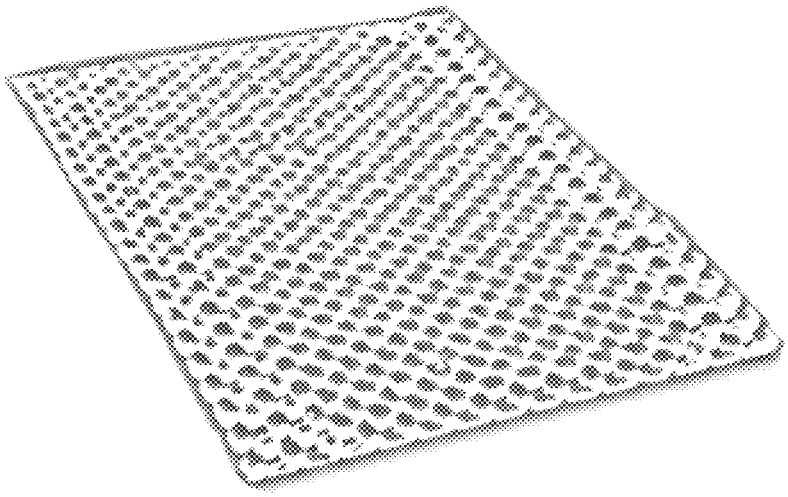
FIG. 21 shows a slider deck including rollers, according to some embodiments.
Figure 22:
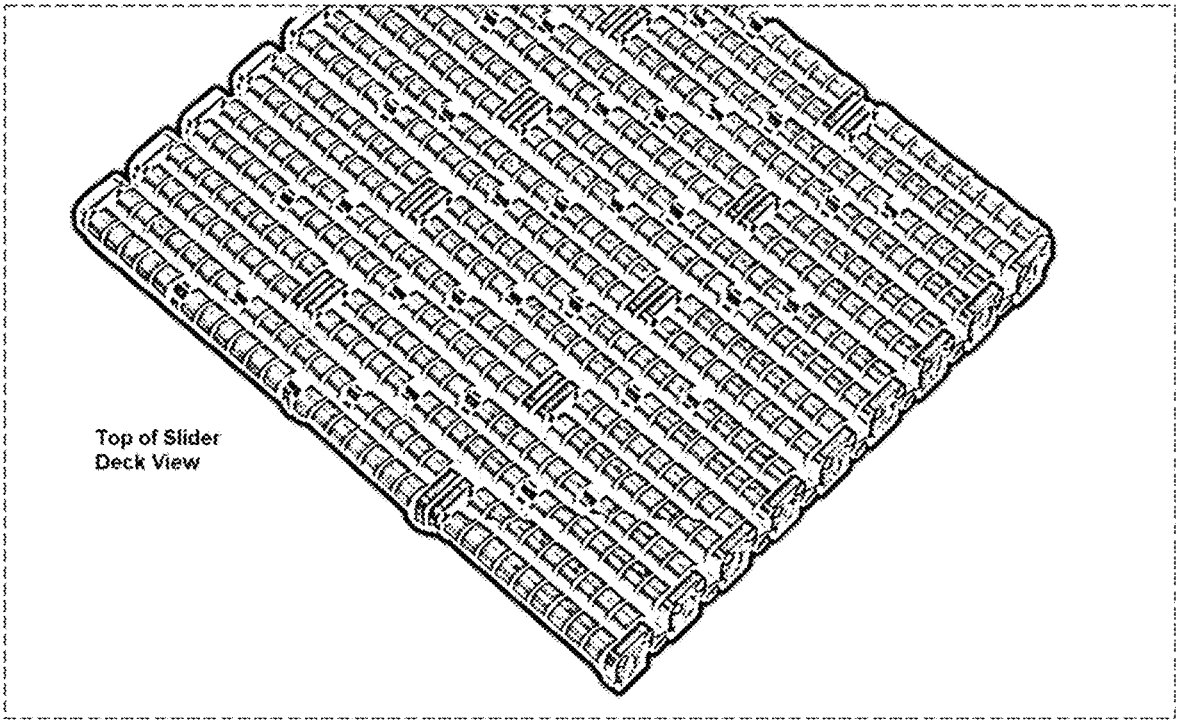
FIG. 22 shows a slider deck including rollers, according to some embodiments.
Figure 23:
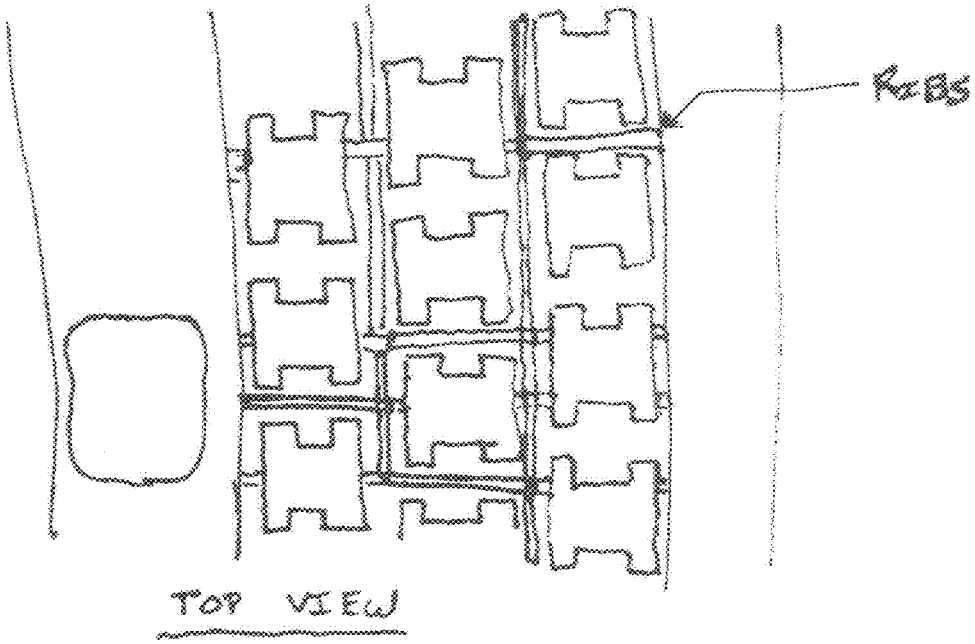
FIG. 23 shows a slider deck including rollers, according to some embodiments.

Some embodiments may include rollers or sprockets arranged on the slider deck, under the belt. The rollers may be arranged on the slider deck in horizontal, vertical or staggered groups, as illustrated in FIGS. 21-23. Including rollers or sprockets in the slider deck reduces the friction between the belt and the slider deck, allowing the belt to roll more smoothly in both the forward and backward directions, and reducing wear.

Figure 24:
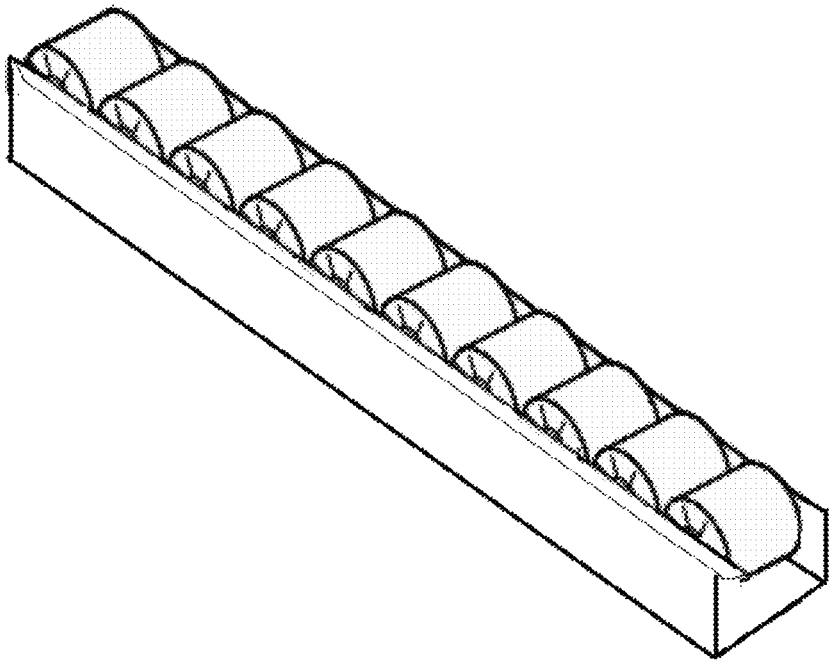
FIG. 24 shows a roller track, according to some embodiments.

In some embodiments, the belts may roll along tracks consisting of strips of freely-moving rollers or sprockets, as illustrated in FIG. 24. Such strips or tracks can also be installed along inner and outer edges of each slider deck, thereby rolling along the belt edges to reduce friction thereon.

Figure 25:
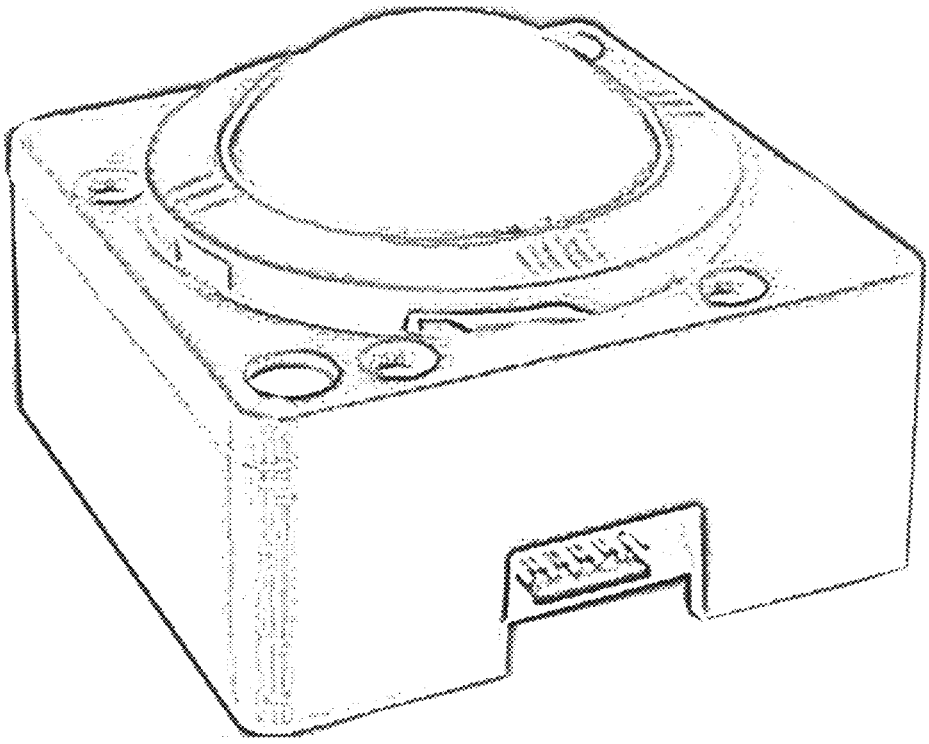
FIG. 25 shows a track-ball module, according to some embodiments.
Figure 26:
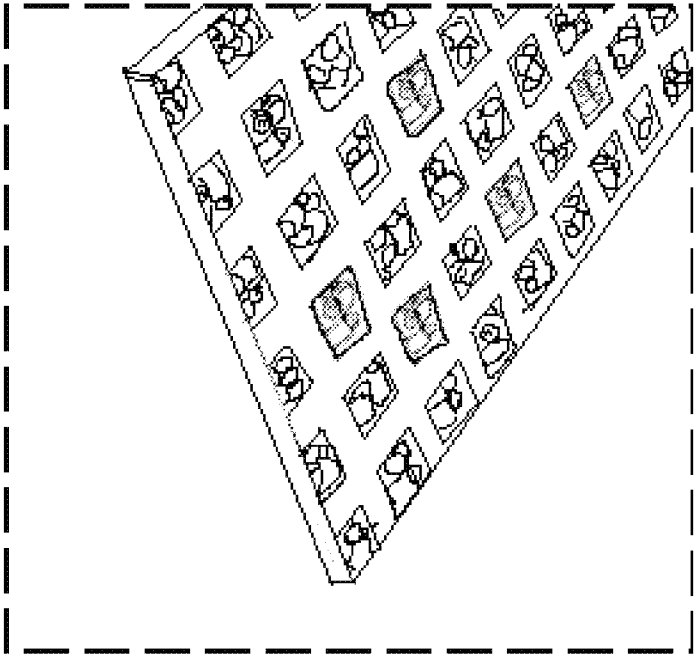
FIG. 26 shows a slider deck including multi-directional rollers, according to some embodiments.

In some embodiments, the belts may roll over an array of multi-directional rollers, as shown in FIG. 25. In other embodiments, the belts may roll over an array of track-ball modules, as shown in FIG. 26. In these embodiments, the multi-dimensional rollers or trackball modules would support the belt above them and reduce the friction between the belt and the framework. These embodiments include belts having the rigidity necessary to travel smoothly over rollers or track-balls while providing a stable, planar tread surface.

Figure 27:
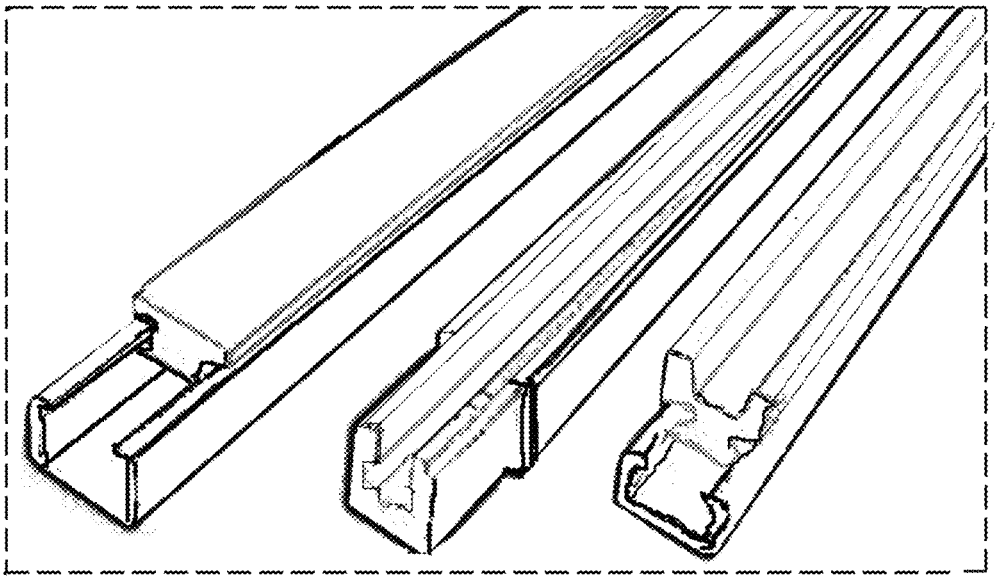
FIG. 27 shows glide-strips, according to some embodiments.
Figure 28:
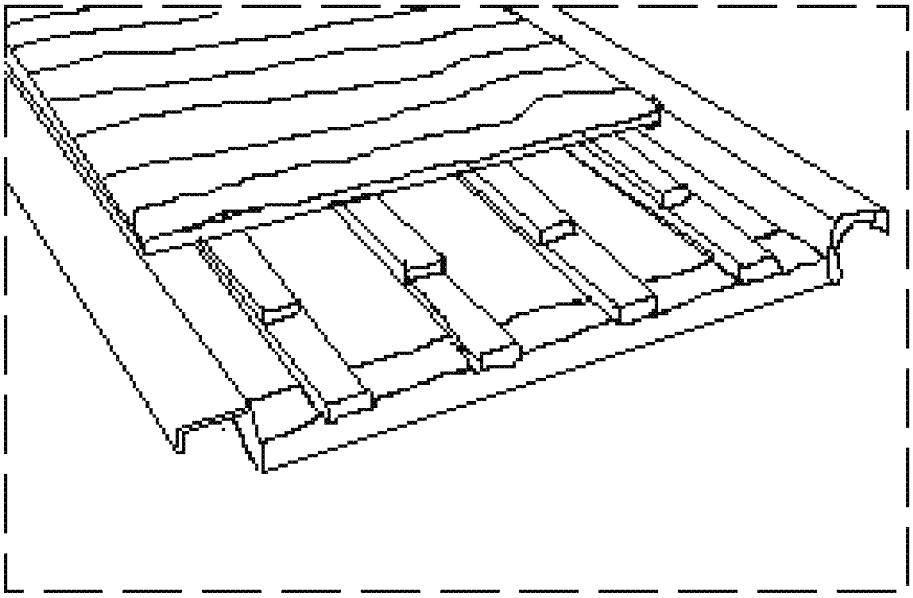
FIG. 28 shows parallel glide-strips, according to some embodiments.

In some embodiments, the belts may glide across glide-strips constructed using a low-friction material such as, e.g., polyethylene. FIG. 27 shows individual glide-strips, according to some embodiments. These glide-strips may be arranged in parallel segments under the belt, as shown in FIG. 28, or in other patterns (e.g., serpentine segments, chevrons, etc.).

Figure 29:
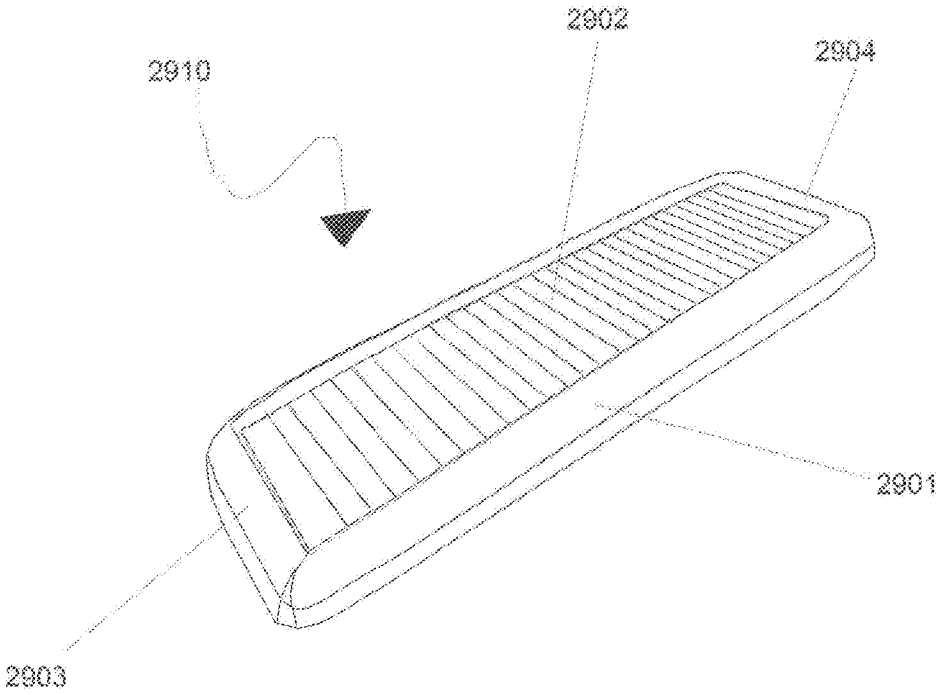
FIG. 29 shows a system with a unitary plastic belt, according to some embodiments.

Some embodiments do not include front and back axles. For example, embodiments in which the belt rolls in the forward and/or backward direction over rollers or track-balls, or glides over glide-strips may not require axles, as the belt is able to roll smoothly around the front and back ends of the framework. In these embodiments, the belts do not need to include sprocket-holes for interlocking with sprockets attached to the front and back axles. Sprocketless plastic belts may allow for a thinner, lighter device with a tighter turning radius and slimmer, lighter slider deck capability. Such belts could the take various forms, including, e.g.: (a) plastic modular belts with pivot pin inserts; (b) pin-less plastic modular belts with snap-together modules that serve as the shafts for the small rollers or wheels; (c) plastic belts of unitary construction with individual module-like or slat-like segments molded, formed or machined thereon (as shown in FIG. 29); (d) a semi-rigid plastic compound exhibiting both the flexibility to wrap around anterior and posterior nosebars (i.e., stationary belt-wrap-around points) and the rigidity to allow for hand- or foot-placement thereon without excessive friction or user discomfort, or (e) a combination of the foregoing.

Relative to FIG. 29, therein is illustrated an apparatus 2910 in which belt 2902 forms a continuous loop around the front 2903 and back 2904 ends of framework 2901. Framework 2901 is free of front and back axles and does not rely on wheels or rollers or other moving parts to convey the belt 2902 continuously around the framework 2901, other than the movement of the belt 2902 itself. As a result, wrap-around points for the belt 2902 positioned at the front 2903 and back 2904 end of the framework 2901 and are stationary, in the sense that they are fixed and non-rotational during use. Accordingly, all of the belt-contacting surfaces of apparatus 2910 are static. Belt 2902, in its preferred embodiment, is constructed of a flexible plastic or foam rubber or similar material with slat-like segments formed directly into the belt 2902 or lateral serrations achieving slat-like appearance, although such slat-like segments may be omitted in some embodiments in favor of other belt patterns or no pattern of all. Belt 2902 is of unitary construction, except for any seams required to join the ends of the belt together through sewing, thermal fusion, glue or other fusion means. As a result, belt 2902 presents an integrally connected user-contact surface, in contrast to such belts as modular belts, which consist of individual slats or belts segments that are connected together by pins and therefore present non-integrally connected seams to be in contact with a user. In its preferred embodiment, belt 2902 is non-modular in the sense that most of its user-contacting surfaces are seamless and integrally connected together, without a plurality of attachment seams requiring pins or other fasteners. As such, all of the user-contacting surfaces of belt 2902 are integral to one another. In some embodiments, user-contactable portions of the belt 2902 comprise spongy foam rubber or similar material. FIG. 29.1 shows a horizontal cross section of the apparatus 2910, wherein belt 2902 is looped around the front 2903 and back 2904 ends of framework 2901, so it may slide continuously in both the forward (counterclockwise) and backward (clockwise) directions on a slider deck 2905. The slider deck 2905 terminates in non-moving ends, without adjacent rollers or wheels. In some versions of the apparatus 2910, a slide-inducing matrix is affixed to the lower surface of belt 2902 and comprises slidable material, such as felt, synthetic felt or similar material, arranged in a pattern with the slide-inducing material interspersed with gaps where such slidable material is not present in order to allow the belt 2901 to maintain sufficient flexibility and bendability to roll around the ends of slider deck 2901 without aid of rollers or axles or the like. In other words, apparatus 2910 in its preferred embodiment is wheel-less and non-motorized system. FIG. 29.2 depicts a partial segment of such a slide-inducing matrix 2930 on a partial segment of belt 2902 comprising slide-inducing-material-covered portions 2931 and non-slide-inducing-material-covered portions 2932. The slide-inducing matrix may take a variety of patterns or designs. The important thing is that the pattern or design facilitates sliding the belt 2902 while allowing to bend around the wrap-around points located at the front 2903 and back 2904 ends of framework 2901 without wheels. Needless to say, belt 2902 is also wheel-less. The system of FIG. 29 is also compatible with a curved or concave slider deck (such that the framework 2901 possess a built-in incline or decline) as shown relative to framework 2901 and belt 2902 in FIG. 29.3, with left and right belts 2941, 2942 as shown in FIG. 29.4 and with an adjustable riser, including one similar to riser 1501 of FIGS. 15A-15B, or a combination of such features.

Figure 32:
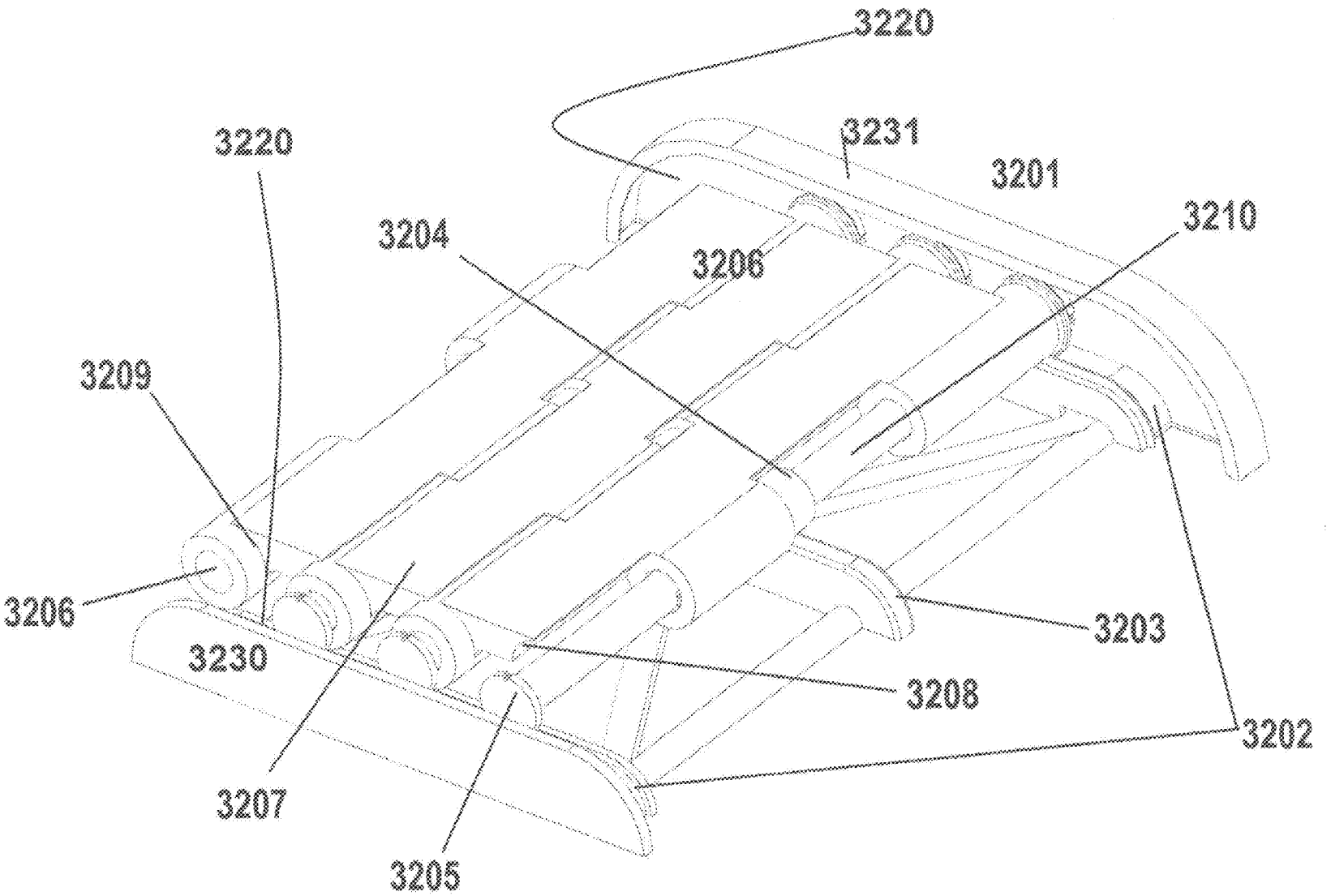
FIG. 32 shows a belt that rolls along three parallel rails, according to some embodiments.
Figure 33:
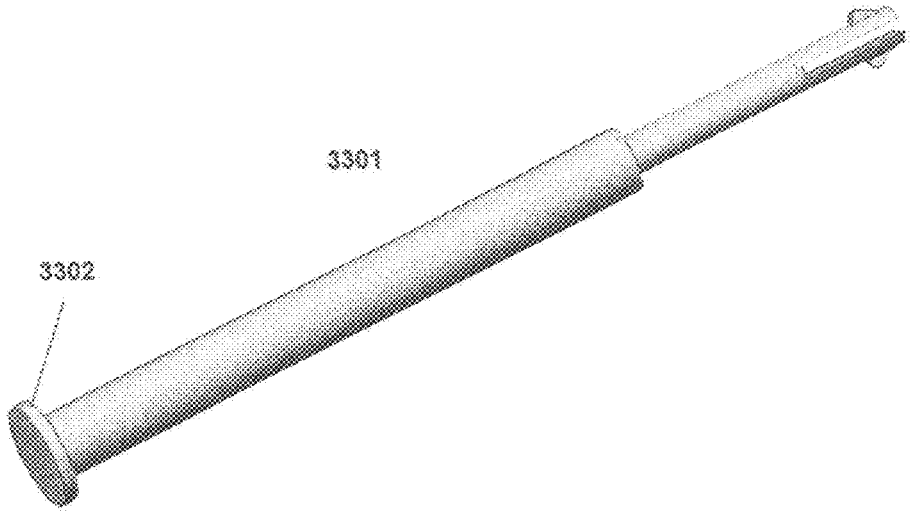
FIG. 33 shows a pin/axle component, according to some embodiments.
Figure 34:
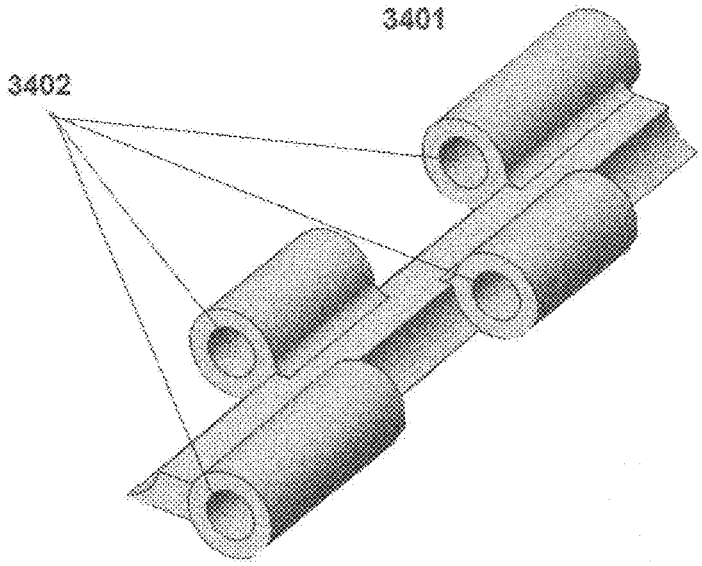
FIG. 34 shows a belt segment with cylindrical holes to accommodate pins and/or axles, according to some embodiments.

In some embodiments, the belts may roll in the forward and/or backward direction across a set of parallel rails, as shown in FIG. 32. Relative to framework 3201, FIG. 32 shows a longitudinal bisection of framework 3201's oval-shaped track 3220, along with a partial segment of belt 3206. In the preferred embodiment, belt 3206 forms a full loop around a full oval-shape of oval-shaped track 3220. Framework 3201 is shown in a configuration that includes three rails: side rails 3202 and center rail 3203. Side wheels 3205 and center wheels 3204 rotate or glide along side rails 3202 and center rails 3203, respectively, which form curvilinear tracks. Center wheels 3204 provide additional support to the center of the belt while still allowing the belt to roll freely over the rails. In this embodiment, the belts are held together by pins that also serve as axles. In various configurations, side wheels 3205 on a left 3230 and/or right 3231 side of framework 3201 may be enclosed by an upper and lower portion of the track 3220. Belt 3206 is composed of a plurality of modular belt segments 3207, communicating along front 3208 and rear curvilinear edges 3209, where they are connected by pin 3210 inserted through cylindrical hinge member 3206. Pin 3210 is configurable to allow an addition of side wheels 3205 and/or center wheel 3204 to provide belt 3206 with a rotational interface with side and center rails 3202, 3203, instead of a wheel-free configuration thereof. FIG. 33 shows a single pin used in this embodiment. The pin includes a shaft 3301 that is inserted into the belt segments to hold them together, and a wheel 3302, that sits in one of the side rails 3202 and rolls as the user of the device moves the belt backward or forward. Wheels 3302 may be included at one or both ends of the pin/axle component, and the pin/axle component may also accommodate as many center wheels as necessary to stabilize the belt or no center wheels at all. In the preferred embodiment, no center wheels 3204 are necessary, and side wheels 3205 are sufficient. FIG. 34 shows a belt segment 3401 that is compatible with this embodiment. Axles like the one shown in FIG. 33 fit through cylindrical openings 3402, simultaneously holding the belt segments together and providing wheels that allow the belt to roll along the three parallel rails 3202 and 3203. FIG. 32.2 illustrates a first belt 3206 and a second belt 3206 arranged on a framework 3201 with deployable riser 3250.1

Additional embodiments of the present invention are further described in U.S. patent application Ser. No. 13/835,066, filed on Mar. 15, 2013, and U.S. patent application Ser. No. 14/784,834, filed on Oct. 15, 2015, which are incorporated herein by reference in its entirety.

What is claimed is:

1. An exercise system configured to allow a user to perform abdominal exercises comprising:

a framework;

at least one belt configured to move around the framework in a clockwise or counterclockwise direction;

a slider deck configured to provide a surface on which the at least one belt is configured to slide;

stationary non-rotational wrap-around areas for the at least one belt positioned at a front end of the framework and a back end of the framework, wherein each of the stationary non-rotational wrap-around points is a convex curved member, and wherein the at least one belt comprises a belt portion formed of a single piece that is configured to be large enough and flexible enough to deform around at least one of the stationary non-rotational wrap-around areas so as to facilitate the at least one belt to move around the framework, wherein the framework is configured such that a user is capable of performing the abdominal exercises by manually rolling the at least one belt forward or backward from each of the front end of the framework and the back end of the framework.

2. The exercise system of claim 1, further comprising a riser member configured such that the user is capable of controlling an amount of force required to move the at least one belt.

3. The exercise system of claim 1, further comprising a riser member configured such that the user is capable of altering an incline of the framework.

4. The exercise system of claim 1, further comprising a riser member, wherein the riser member is configured to be positionable at each of a front end of the framework and at a back end of the framework.

5. The exercise system of claim 1, further configured such that the front end of the framework and the back end of the framework are configured to lie in flat contact with the ground surface.

6. The exercise system of claim 1, wherein the at least one belt comprises a first belt and a second belt, wherein the first belt is configured to support a left limb of the user, and wherein the second belt is configured to support a right limb of a user.

7. The exercise system of claim 1, wherein the exercise system is configured to be stackable with other exercise systems for storage.

8. An exercise system comprising:

a framework;

at least one belt configured to move around the framework in a clockwise or counterclockwise direction;

a slider deck configured to provide a surface on which the at least one belt is configured to move;

stationary non-rotational wrap-around areas for the at least one belt, wherein the stationary non-rotational wrap around areas comprise a first wrap around area positioned at a front end of the framework and a second wrap-around area positioned at a back end of the framework, wherein each of the stationary non-rotational wrap-around areas is a convex curved member, wherein the at least one belt is configured such that when it is resting on the framework, the at least one belt lies flatly on a middle portion of the framework and wraps around the stationary non-rotational wrap-around areas, with that portion of the at least one belt that wraps around the first wrap-around area or the second wrap-around area being made of a single piece of flexible material, and wherein the exercise system is configured to be stackable with other exercise systems for storage.

9. The exercise system of claim 8, wherein the at least one belt comprises a first belt and a second belt, wherein the first belt is configured to support a left limb of the user, and wherein the second belt is configured to support a right limb of a user.

10. The exercise system of claim 8, wherein the exercise system is configured to allow a user to perform abdominal exercises.

11. The exercise system of claim 8, further comprising a riser member configured such that a user is capable of altering an incline of the framework.

12. The exercise system of claim 8, further comprising a riser member configured to allow a user to control an amount of force required to move the at least one belt.

13. The exercise system of claim 8, further comprising a riser member, wherein the riser member is configured to be positioned at each of a front end of the framework and a back end of the framework.

14. The exercise system of claim 8, further configured such that a front end of the frame and a back end of the frame are configured to lie in flat contact with the ground surface.

15. The exercise system of claim 8, wherein the framework is further configured for a performance of abdominal exercises, and where in the framework is configured such that a user is capable of performing the abdominal exercises by manually rolling the at least one belt forward or backward from each of the front end of the framework and the back end of the framework.

* * * * *